US010388147B2

(12) United States Patent
Prokofyeva et al.

(10) Patent No.: US 10,388,147 B2
(45) Date of Patent: Aug. 20, 2019

(54) DATA DRIVEN ALERT SYSTEM

(71) Applicant: AT&T Intellectual Property I, L.P., Atlanta, GA (US)

(72) Inventors: Elina Prokofyeva, Ocean, NJ (US); Roque Rios, III, Middletown, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 14 days.

(21) Appl. No.: 15/364,560

(22) Filed: Nov. 30, 2016

(65) Prior Publication Data

US 2018/0151055 A1 May 31, 2018

(51) Int. Cl.

| | |
|---|---|
| ***G08B 25/01*** | (2006.01) |
| ***G08B 25/00*** | (2006.01) |
| ***G08B 25/08*** | (2006.01) |
| ***G08B 25/10*** | (2006.01) |
| ***G08B 27/00*** | (2006.01) |
| ***G08B 29/16*** | (2006.01) |

(52) U.S. Cl.

CPC ..... *G08B 27/00* (2013.01); *G08B 27/005* (2013.01); *G08B 27/006* (2013.01); *G08B 29/16* (2013.01)

(58) Field of Classification Search

CPC .... H04W 4/22; H04W 76/007; G08B 25/005; G08B 25/006; H04M 11/04; H04M 2242/04; H04M 1/72536; H04M 2242/15; H04M 3/5116; H04H 20/59

See application file for complete search history.

(56) References Cited

U.S. PATENT DOCUMENTS

| | | | | |
|---|---|---|---|---|
| 7,119,675 | B2 | 10/2006 | Khandelwal et al. | |
| 8,102,245 | B2 | 1/2012 | McCarthy et al. | |
| 8,368,530 | B1 * | 2/2013 | Zhang | H04W 4/22 340/506 |
| 8,380,159 | B2 | 2/2013 | Sennett et al. | |
| 8,509,729 | B2 | 8/2013 | Shaw | |
| 8,554,169 | B2 * | 10/2013 | Daly | H04W 4/22 340/539.11 |
| 8,583,076 | B2 | 11/2013 | Foladre et al. | |
| 8,976,938 | B2 | 3/2015 | Zerillo et al. | |
| 9,301,117 | B2 | 3/2016 | Leggett et al. | |
| 2009/0024759 | A1 | 1/2009 | McKibben et al. | |
| 2009/0285369 | A1 | 11/2009 | Kandala | |
| 2011/0095881 | A1 | 4/2011 | Rosentel et al. | |
| 2012/0164968 | A1 * | 6/2012 | Velusamy | H04W 4/90 455/404.2 |
| 2013/0157610 | A1 | 6/2013 | Vainik et al. | |
| 2014/0287711 | A1 * | 9/2014 | Williams | H04M 1/72538 455/404.1 |
| 2015/0065081 | A1 * | 3/2015 | Estes | H04W 4/021 455/404.2 |

* cited by examiner

*Primary Examiner* — Quan-Zhen Wang
*Assistant Examiner* — Rajsheed O Black-Childress
(74) *Attorney, Agent, or Firm* — BakerHostetler

(57) ABSTRACT

A flexible, multi-channel alert system is described herein. A technique for implementing such can include generating an emergent event alert in response to notification of an emergent event, identifying a plurality of devices to transmit the emergent event alert, determining at least one device among the plurality of devices requiring an override operation to output the emergent event, identifying a plurality of channels to connect to the devices, transmitting the emergent event alert over the plurality of channels, and initiating the override operation on the at least one device.

11 Claims, 12 Drawing Sheets

DATA DRIVEN ALERT SYSTEM

TECHNICAL FIELD

The disclosure herein generally relates to alerting parties to emergent events, and particularly to alerting parties to emergent events using a variety of available devices and channels.

BACKGROUND

Today's world is more connected than ever, and connectivity is only expected to increase. There is an expectation that mobile devices are always on, and that communicators can reach recipients at any time, and recipients frequently believe themselves to be fully available and aware.

However, devices and channels must now compete for our interest, and the rare occasion when a mobile device is left behind or turned off can create gaps in connectivity at critical instances. Users may silence their cellular phone or leave it on a charger in another room while streaming a movie only to discover hours later that an urgent communication was missed.

SUMMARY

In an embodiment, a method includes generating an emergent event alert in response to notification of an emergent event, identifying a plurality of devices to transmit the emergent event alert, determining at least one device among the plurality of devices requiring an override operation to output the emergent event, identifying a plurality of channels to connect to the devices, transmitting the emergent event alert over the plurality of channels, and initiating the override operation on the at least one device.

In an embodiment, a system includes an event detection component that receives details regarding an emergent event, an alert generation component that generates an emergent event alert, and a device identification component that identifies a plurality of devices to transmit the emergent event alert.

In an embodiment, system includes a processor executing instructions stored on a non-transitory computer readable medium. The instructions define a method including steps of receiving data including details regarding an emergent event, generating an emergent event alert, identifying a plurality of devices using which to transmit the emergent event alert to a party, identifying a plurality of channels to connect to the devices, and transmitting the emergent event alert over the plurality of channels.

In embodiments, non-transitory computer readable media can store instructions for performing or causing aspects disclosed herein.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to limitations that solve any or all disadvantages noted in any part of this disclosure.

BRIEF DESCRIPTION OF THE DRAWINGS

Aspects of the herein disclosed are described more fully with reference to the accompanying drawings, which provide examples. In the following description, for purposes of explanation, numerous specific details are set forth in order to provide an understanding of the variations in implementing the disclosed technology. However, the instant disclosure may take many different forms and should not be construed as limited to the examples set forth herein. Where practical, like numbers refer to like elements throughout.

DETAILED DESCRIPTION

Figure 1:
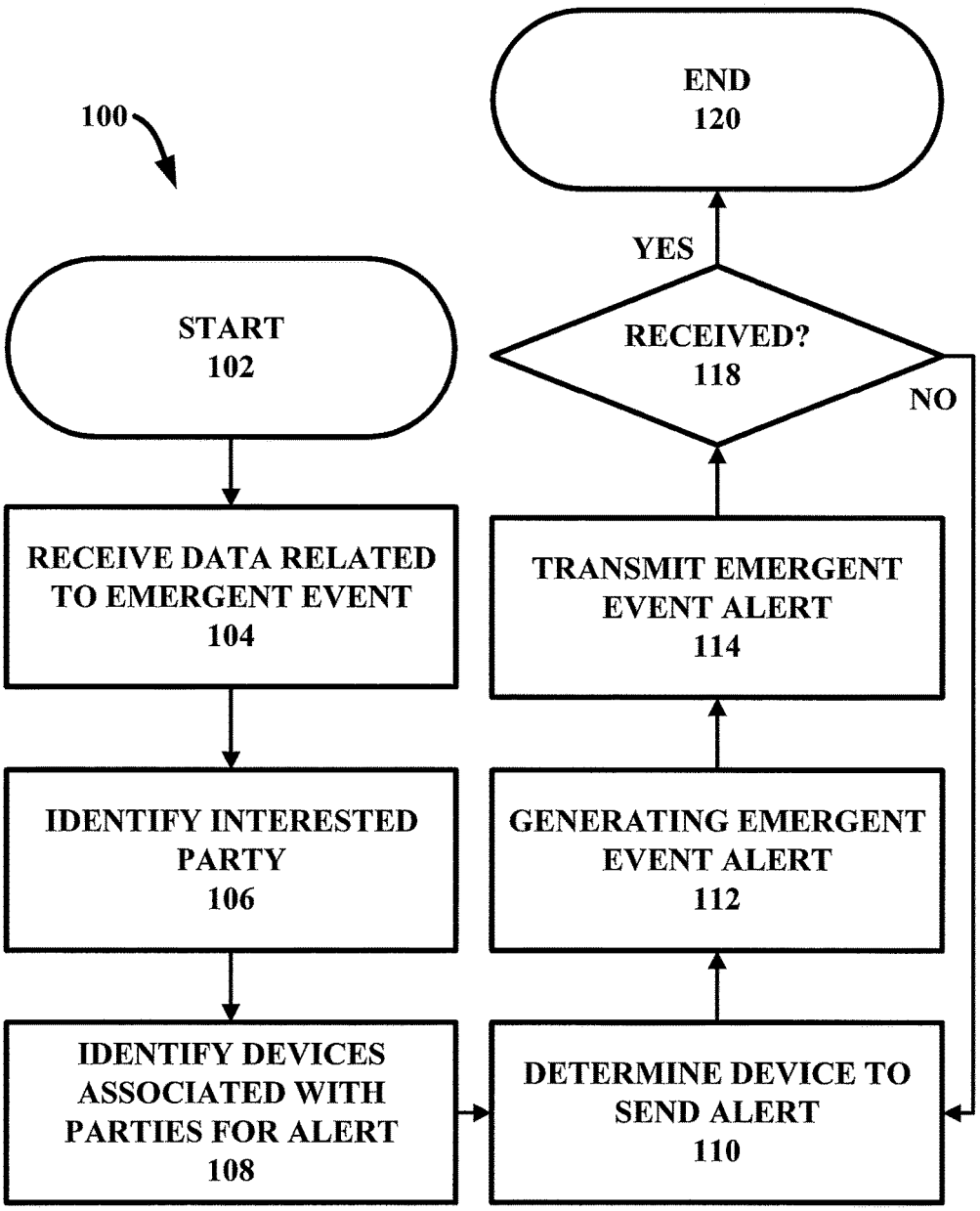
FIG. 1 illustrates a flow chart of an example methodology for providing emergent event alerts disclosed herein.

The disclosures herein generally relate to a data driven alert system capable of alerting interested parties of relevant emergent events using a variety of devices and channels. As an increasingly large amount of information is available to device users and an increasing number of devices are involved in everyday life, it becomes harder to ensure emergent events stand out from a volume of non-emergent traffic. To improve the likelihood of prompt notification, devices may be contacted simultaneously or successively to provide users with information or gain user attention to move them toward the emergent information. In embodiments, voluntary or involuntary override procedures can be invoked to take control of devices where settings or use would otherwise prevent an interested party from receiving emergent information. Generation, transmission, and presentation of data driven alerts can be a passive process requiring no user interaction.

As used herein an "emergent event" can be any happening of interest to an interested party. These can include, but are not limited to, weather developments, traffic developments, police or crime reports, fire reports, medical events, news (e.g., political, business, sports), social media publications, information from applications or services, and so forth. Data related to emergent events can come from various network services, radio services, scanners, media sources, et cetera.

Emergent events can be specific to an interested party or parties, and may have greater or less relevance to multiple parties which could consider the event emergent. Relevance can be geographical whereby the emergent event interests or affects people in a geographic region. Geographically relevant events can include, for example, severe weather, public transportation delays, traffic, et cetera. Relevance can also be personal. Personally relevant events can be public or private. A public personally relevant event can be one that is relevant to a subset of a population based on characteristics of individuals in the population based on the individuals' interactions with the environment. For example, a public personally relevant event can be public transportation delays based on the system's information that the interested party does in fact travel using an impacted public transportation route. A private personally relevant event can relate to the party based on characteristics of individuals in the population based on the individuals' relationships or interests (e.g., family, friends, employer, interests). For example, a private personally relevant event can be a family member in a hospital, a flat tire on an individual's car, or a sale at a store they prefer. Relevance can be inferred (e.g., based on device use) or provided (e.g., opt-in).

As used herein, a "device" can be any electronic device with a network connection capable of sensing and transmitting sensed information or of receiving information and providing an output based on that information. The output can be visual (screen, lights, et cetera), audio (generating or playing back voice, tones, or other sounds, et cetera), haptic (vibration, pulsing, et cetera), or others. In embodiments, output can be a part of an interface which can also receive information. Example devices may include, but are not limited to, smart televisions, smart appliances (e.g., refrigerator, washing machine), smart home controls (e.g., thermostat, locks, lights), computers (e.g., laptop, desktop), tablets, mobile phones, personal assistant devices, media players, vehicles with communication capability, drones, speakers, Internet of Things (IoT) devices, and others.

Devices can include device channels. Device channels are information paths for device communication or control. Device channels can include various hardware of software communication ports, browsers, applications, executables, interfaces, or sensors. For example purposes only, some (but not all) channels in a mobile device can include cellular channels for voice and SMS, cellular data channels which can contact device hardware or firmware as well as installed applications which receive data using network connections (all of which can be identified as separate channels, e.g., a web browser has one or more channels, a game has one or more channels), WiFi data channels, BlueTooth data channels, infrared data channels, et cetera.

Turning to the drawings, FIG. 1 illustrates a methodology 100 for identifying and transmitting alerts related to emergent events. Methodology 100 begins at 102 and proceeds to 104 where data is received related to an emergent event. With information regarding the emergent event, one or more interested parties can be identified at 106. Identification of interested parties can be based on identifying interests or opting-in expressly; relationships or contacts (e.g., frequent contacts, family members, colleagues); analysis of their behavior or data generated by or about them; the party's geographic location or physical locations of interest; logical locations of party information or interest; affiliations, memberships, or business connections; and in other manners.

Once parties interested in the emergent event are identified, at 108, devices associated with the interested party or parties can be identified. The devices identified can be all known or discoverable devices owned or used by, or associated with, an interested party.

Thereafter, at 110, methodology 110 determines one or more devices to which to transmit an alert. These devices can be all devices identified, or a subset thereof. The devices can be selected, with no alert transmitted to non-selected devices, or prioritized, with one or more priority tiers having one or more devices per tier such that alerts are transmitted or re-transmitted to different priority tiers based on whether they are affirmatively or passively received.

A variety of parameters, filters, and analyses can determine device selection and/or priority. For example, devices which may be selected and/or given higher priority can include currently or recently active devices, devices involved in network communication, devices currently powered, devices with stable power or substantial battery life (e.g., battery life over 10 percent, battery life over 25 percent), devices dedicated to the interested party, devices having visual interfaces, devices having audio interfaces, devices having haptic interfaces, devices with an application or communication interface installed, devices for which overrides are available, devices with location information suggesting travel with the user, devices with which the user has previously acknowledged or received alerts, and so forth. Devices which are non-selected or given lower priority can be those devices which have not been recently active, lack immediate communication or power, are shared between users, lack an interface which could present an alert, lack a communication interface to receive alert data, devices which lack overrides, devices which are static while the interested party is moving, devices which are non-mobile, devices with which the user has infrequently or not previously acknowledged or received alerts, and so forth.

In an embodiment, these and other variables can be used to determine a notification success probability. The notification success probability can be used to select one or more devices which have the highest probability or are above a threshold of probability. The notification success probability can alternatively or complementarily be used to prioritize devices which can receive transmissions associated with an alert simultaneously in tiers and/or successively.

Where multiple transmissions are carried out successively or in tiers, a timeout for active or passive confirmation of receipt can be used to determine when a next notification should be sent. The timeout can vary depending on the device or emergent event. For example, a mobile device may have a shorter timeout than a smart appliance, or a personal medical emergency may have a shorter timeout than a regional weather issue. When a timeout expires, an alert can be transmitted to the next device, devices, or tier of devices.

With at least one device identified to send the alert, an emergent event alert can be generated at 112. The emergent event alert can be standard to two or more device types, or customized based on the specific device and its availability (e.g., current use, communication channels available, power or bandwidth required based on nature of alert). In embodiments, the emergent event alert can be generated earlier in methodology 112. However, in the embodiment illustrated, the emergent event alert may be generated based on known information regarding the devices in addition to the alert itself.

As suggested above, there can be multiple versions or variants of the same alert. Complementary or assist alerts send through lower priority devices or channels can be used to gain interested party attention even where details of the emergent event cannot be determined from such alerts (e.g., flashing lights from a microwave or an audible alarm from a home security system cannot necessarily describe the emergent event but can gain attention).

Thereafter, at 114, the emergent event alert can be transmitted to the device(s) selected or prioritized. At 118 a determination can be made as to whether the alert was received. If the alert was not received, methodology 100 can recycle to 110 where a determination is made as to a device to send a subsequent alert. The device can be the same device, a different device, or multiple devices including same or different devices, and the alert can be the same or different (e.g., louder alarm to first device and new alert to second device).

If, at 118, the alert is confirmed or inferred to be received (e.g., acknowledgement returned, action taken related to alert, user takes other actions with device), methodology 100 can advance to 120 and end.

Figure 2:
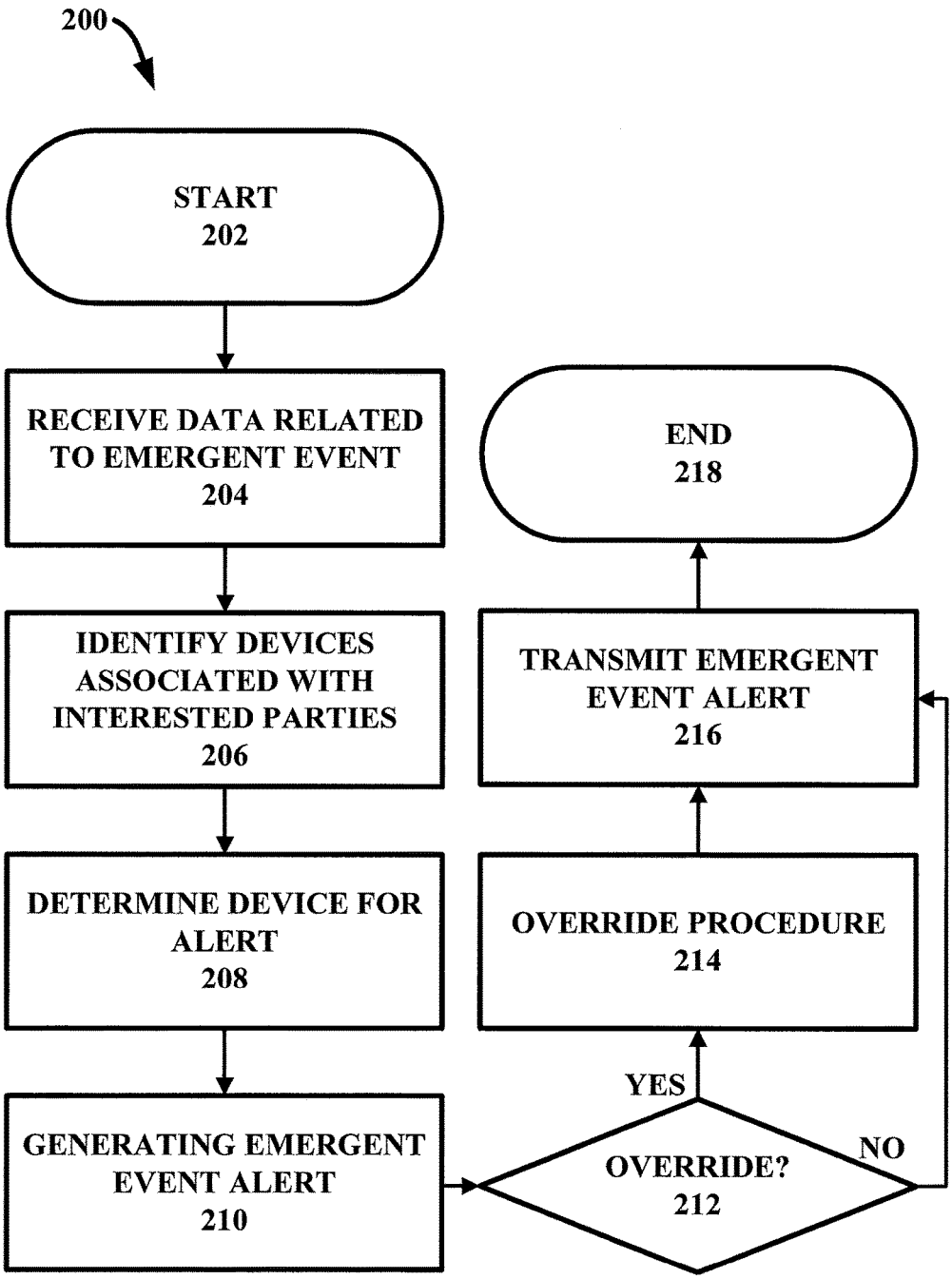
FIG. 2 illustrates a flow chart of another example methodology for providing emergent event alerts disclosed herein.

Turning to FIG. 2, a methodology 200 for providing emergent event alerts is illustrated. Methodology 200 begins at 202 and proceeds to 204 where data related to an emergent event is received. At 206, devices associated with interested parties are identified, and at 208, at least one device to which to send an alert is identified. An aspect of 208 can also determine particular channels available to a device to send an alert. This determination can be based on channel availability or accessibility, stability, control, usage (by the interested party), et cetera. For example, channels which are linked through stable connections, part of voluntarily-installed applications, have resources to deploy the alert, which can control aspects of a device related to the alert, are currently in use by an interested party, and so forth, can be identified and selected or prioritized accordingly. With the device and channel selected, a standard or customized emergent event alert can be generated at 210.

Based on the device, channel, and event alert, a determination can be made at 212 as to whether an override is necessary. In embodiments, a device may not include native capability to receive or handle an emergent event alert, or its settings, activity, or standard behaviors may prevent the alert from being broadcast in a manner likely to successfully gain the interested party's attention. In this fashion, methodology 200 can employ an override to ensure the alert is properly received and transmitted. The override can be, for example, an encoded SMS message, an HTTP transmission, a transmission including instructions sent through a proprietary protocol (e.g., according to the operation of a smart appliance), a code or instruction utilizing an intentional or unintentional opening in an application or operating system, data sent through an application programming interface (API), leveraging of a voluntarily or involuntarily installed application or executable, or a security exploit. Other possibilities will be apparent in view of the disclosure herein. The override can utilize brute-force techniques, and store data on unconventional or involuntary manners which can be used to access or seize devices for emergent notifications where a device does not have the capability (or is not currently set up) to attract a user's attention with an alarm or where the available functions have been insufficient to gain the user's attention (e.g., no ring associated with e-mail delivery or pop-up notification). This can include noncompliant or deliberately mis-formatted message to effect an error state on a device or trigger non-linked or disabled functionality, or sending transmissions to devices which interact with the target device to influence target device behavior (e.g., power cycling a smart outlet to cause a smart television to power down and restart non-captive to a streaming media application).

If it is determined that an override is required at 212, a standard or device-specific (e.g., specific to the device model, environment, settings, or user) override procedure can be executed at 214. If no override is required at 212, or after completing the device override procedure at 214, methodology 200 proceeds to 216 where the emergent event alert is transmitted to the device in accordance with available reception. Thereafter, at 218, methodology 200 ends.

Other variants of FIGS. 1 and 2 (e.g., combinations and permutations of one or more aspects from each methodology) will be understood in view of the disclosures herein. In a non-limiting example combining aspects of both methodologies 100 and 200, the family member of an interested party can be checked in at a hospital. Information about the emergent event can be actively produced (e.g., by the patient, a family member, a care provider, or others) or inferred (e.g., car accident detected in networked vehicle and mobile device proceeds to hospital without car). Based on the emergent event information, at least one interested party can be identified. The party identified can be a family member, friend, coworker, et cetera, as opposed to, e.g., all people within a geographic area. In embodiments, multiple emergent event alerts can be generated related to a single event. For example, if the emergent event is a car accident, a first alert concerning personal relevance can notify family of a hospital admittance, whereas a second alert concerning geographic relevance can notify others of a lane closure due to the accident. With at least one interested party identified, a plurality of devices associated with the interested can be identified. For example, a family member may have smart kitchen appliances, a mobile phone, a tablet, a laptop computer, a smart TV, and a car with networked systems. One or more channels for each can be identified—a smart refrigerator may only have one channel (e.g., one network communication technique to access lighting or audible alarms) while the mobile phone has several (e.g., voice, data, SMS, applications). Priorities can be assessed—mobile phone first, tablet and computer next, remaining devices last—and an emergent event alert generated for one or more of the devices and channels. The emergent event alert can then be sent to the highest priority device(s) or first tier priority (e.g., mobile phone) for receipt. The phone may not have a built in alert system in place, so an override may be used, such as a coded SMS message or HTTP transmission that activates the phone or overtakes its current utilization to ensure the alert is displayed. If a timeout is reached without confirming the emergent event alert was acknowledged on the phone, the same or a different emergent event notification can be sent to other devices (e.g., notification on tablet and computer, e-mail to one or both, message in social media application in one or both, call to application in one or both). If a subsequent timeout occurs, the third tier can be used to promulgate alerts which, if lacking information, at least direct the interest party's attention to other devices. An example here could be blinking lights or audible alarms from a smart refrigerator. In an embodiment, one of the alerts can interrupt a streaming media service on a smart TV, through a media dongle, or on a computer. In this manner, a user immersed in a movie or music who is not paying attention to a cellular phone or other devices can be notified. In embodiments, alerts can continue until acknowledged on one or more devices. An acknowledgement from any device can disable or pause alerts on all devices. As suggested, different notifications on different devices can act alone or in combination at any time. For example, when a first tier times out, a more noticeable notification (e.g., ringer as opposed to pop-up) can be provided via the first tier before or simultaneously with actuating alerts on the second tier.

A variety of further variants to these techniques are possible. In at least one embodiment, an alert is transmitted on all available channels. In an embodiment, advertising or commercial notifications can be provided. Sensors in conjunction with emergent event alerts can be used to assist with car upkeep or maintenance (e.g., gas levels, tire wear), household upkeep or stocking (e.g., pantry empty, windows open while heat running), or other applications.

Figure 3:
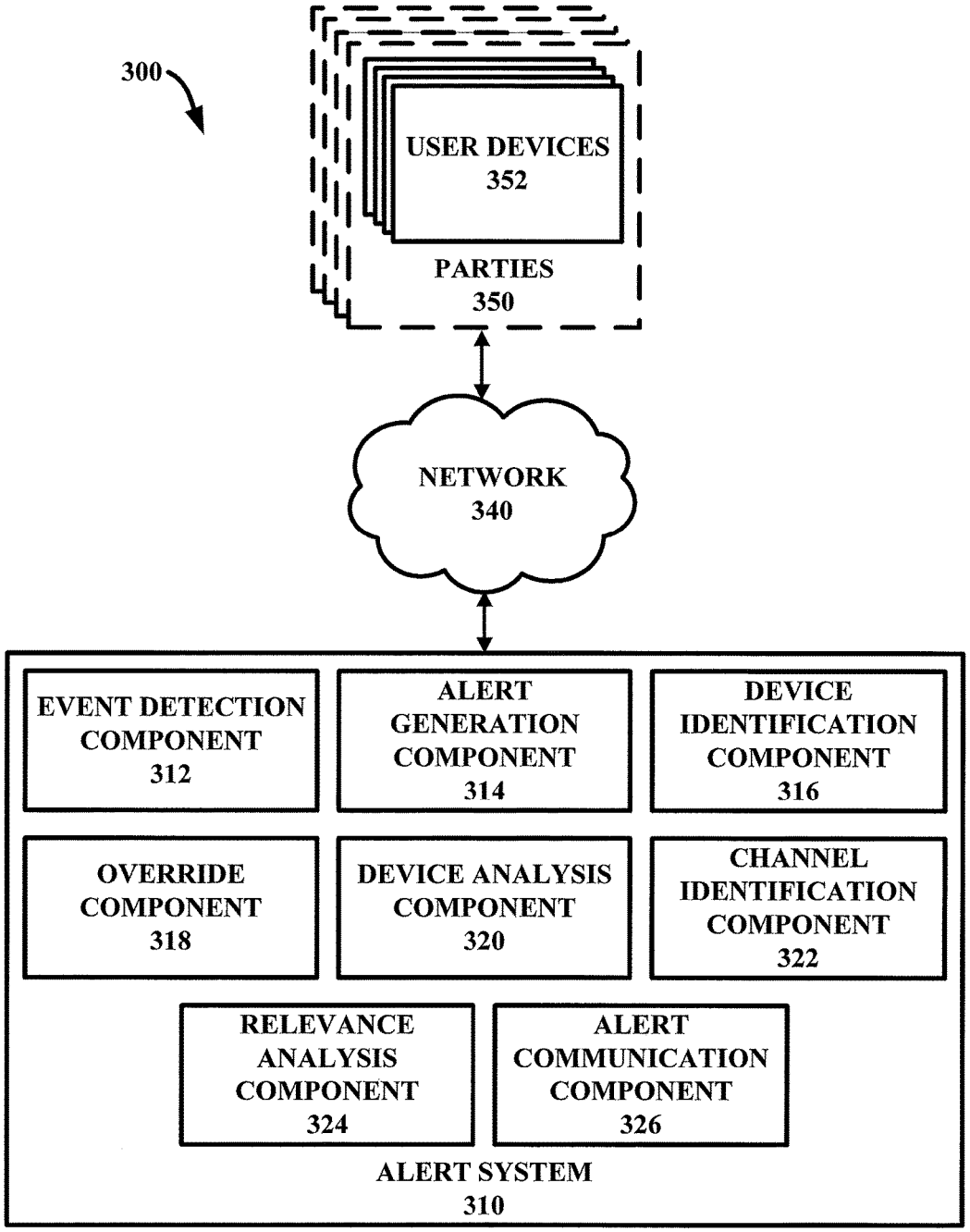
FIG. 3 illustrates a block diagram of an example alert system disclosed herein.

FIG. 3 illustrates a block diagram of a system 300 for providing emergent event alerts. System 300 includes alert system 310 which is communicatively coupled with groups of devices 352 associated with parties 350 via network 340.

Alert system 310 includes, in various embodiments, some or all of the illustrated components, which can be configured to perform, execute, or effect aspects described above with regard to FIGS. 1 and 2 and other portions of the disclosure.

In embodiments, alert system 310 includes event detection component 312. Event detection component 312 can receive, detect, or sense information related to an emergent event. In this regard, event detection component can be communicatively coupled (e.g., via network 340) to a variety of information sources. Such information sources can include, but are not limited to, weather services, traffic services, police services, fire services, medical services, social media, news websites, third party applications or APIs, private applications or APIs (e.g., monitors or feeds related to family or business), other devices, IoT devices (e.g., vehicular or home appliances or systems with sensors), e-mail services, data messaging services, SMS messaging services, proprietary messaging services, voicemail services, voice call services, and others. Information received can immediately be flagged as an emergent event, or analyzed to determine whether an emergent event has occurred. In embodiments, corroboration from subsequent data or alternate channels can be sought after initial emergent event information is received.

In embodiments, alert system 310 includes alert generation component 314. Alert generation component 314 can generate an alert according to one or more techniques to provide information relating to an emergent event using at least one of devices 352, or to gain the attention of one or more of users 350 with one of devices 352. Alert generation component can generate data in one or more formats such that it is able to communicate across all channels with one or more of devices 352.

In embodiments, alert system 310 includes device identification component 316. Device identification component 316 can receive information from a user to identify devices associated with the user, or discover devices associated with a user. In an embodiment, a user can manually enroll one or more devices in an alert system 310 by installing an application, creating a communication link, providing a logical address, opening a link, or other steps. In an embodiment, device identification component 316 can discover other devices by exploring one or more networks or subnetworks on which a known user device operates. In an example, communication with network elements such as routers or modems can be used to discover other devices in communication therewith, and/or contact messages can be routed through a home or business network to discover smart or IoT devices, and/or a known user device can be monitored for other connections (via, e.g., WiFi, BlueTooth, infrared, cellular, and so forth) to determine other devices (e.g., vehicle with IoT systems aboard). Data describing devices 352, when provided or discovered, can be stored in one or more databases associating devices 352 with respective users 350. The databases can include a secure lookup table which is encrypted on the server side to ensure security related to devices associated with a user.

Device identification component 316 can utilize internet service provider services or resources to identify devices. Internet service providers may map downstream client networks in terms of devices thereon (e.g., modem, router, computers, tablets, smart electronics) which can be used to identify devices owned by, used by, or near a particular interested party. In embodiments, manufacturers may manufacture devices to one or more standards which interact with device identification component 316 to allow for their discovery and/or enrollment. In embodiments, software (e.g., application) or hardware (e.g., USB dongle) can be added to a device to enroll it in system 300. In embodiments, device identification component 316 can utilize machine learning algorithms to assist with device discovery.

In embodiments, alert system 310 includes override component 318. Override component 318 can operate alone or in conjunction with other elements of alert system 310 (e.g., device identification component 316, alert generation component 314, device analysis component 320, channel identification component 322) to generate overrides for delivering an emergent event alert. These overrides are provided to ensure that emergent event information is received by the target device, or that signals controlling the target device to direct the user's attention to a device carrying the emergent event information is received and actioned. Override component can leverage voluntarily installed or stored applications or executables, involuntarily installed or stored applications or executables, encoded SMS messages, browser redirects, subtitle interruption (e.g., in a video), segment replacement in adaptive bitrate streaming, auto-pausing media, et cetera.

In embodiments, alert system 310 includes device analysis component 320. Device analysis component 320 can operate alone or in conjunction with other elements of alert system 310 (e.g., device identification component 316, alert generation component 314, device analysis component 320, channel identification component 322) to analyze devices to determine their models, versions, software, communication means (e.g., hardware, software, logical and/or physical ports), range, capabilities, sensors, interfaces, outputs, et cetera. Device analysis component 320 can develop information for alert system 310 to determine what devices to which alert system 310 can provide an emergent event notification, as well as when, where, and how. In embodiments, device analysis component can be used to select or prioritize devices 352 for emergent event alerts.

In embodiments, alert system 310 includes channel identification component 322. Channel identification component can operate alone or in conjunction with other elements of alert system 310 (e.g., device identification component 316, alert generation component 314, device analysis component 320) to provide additional information relating to available channels through which a device can be contacted or controlled. Information received, detected, or inferred using device analysis component 320 can be leveraged or further developed to determine the availability and capability of various channels in a device to determine what alert(s) the device can receive.

In embodiments, alert system 310 includes relevance analysis component 324. Relevance analysis component 324 can analyze a detected emergent event to discern one or more parties 350 to which the event is relevant for purposes of providing an emergent event alert. This analysis can be based on identity (individual or group), relationships (as provided or determined from communications and social media), location, demographics, employer or profession, travel plans, activities, et cetera. Relevance analysis component 324 can generate a relevance score that causes an alert to be transmitted to a party if a threshold is exceeded (e.g., defining them as an interested party) or if any relevance is detected. Relevance analysis component 324 can also generate a relevance priority whereby different notifications are provided based on relevance. For example, a tornado can be reported in an area twenty miles from where two colleagues work. The tornado may be in the vicinity of one colleague's house, which is not near the residence but along a commuting route for the other colleague. The colleague with the house proximate to the reported tornado may receive an emergent event alert to multiple devices leveraging override procedures to ensure he immediately receives the alert. The other colleague may receive a text message, or a delayed notification (or no notification at all) based on his expected or detected travel timing and the situation expected for that time.

In embodiments, alert system 310 includes alert communication component 326. Alert communication component 326 can enable alert system 310 to transmit emergent event alerts to other devices. In embodiments, alert communication component 326 can receive feedback from those devices. In embodiments, alert communication component 326 can utilize network 340 for communication. In alternative or complementary embodiments, alert communication component 326 can connect to a device by means other than network 340 (e.g., BlueTooth, infrared).

Alert systems such as alert system 310, and methodologies or techniques for providing alerts, may be used in a variety of environments and with a variety of devices. For example, a network device can be one of devices 352, or store, administer, manage, execute, or otherwise control some or all of alert system 310. Further, various wired and wireless networks can be used with emergent event alert systems and methodologies disclosed herein.

Figure 4:
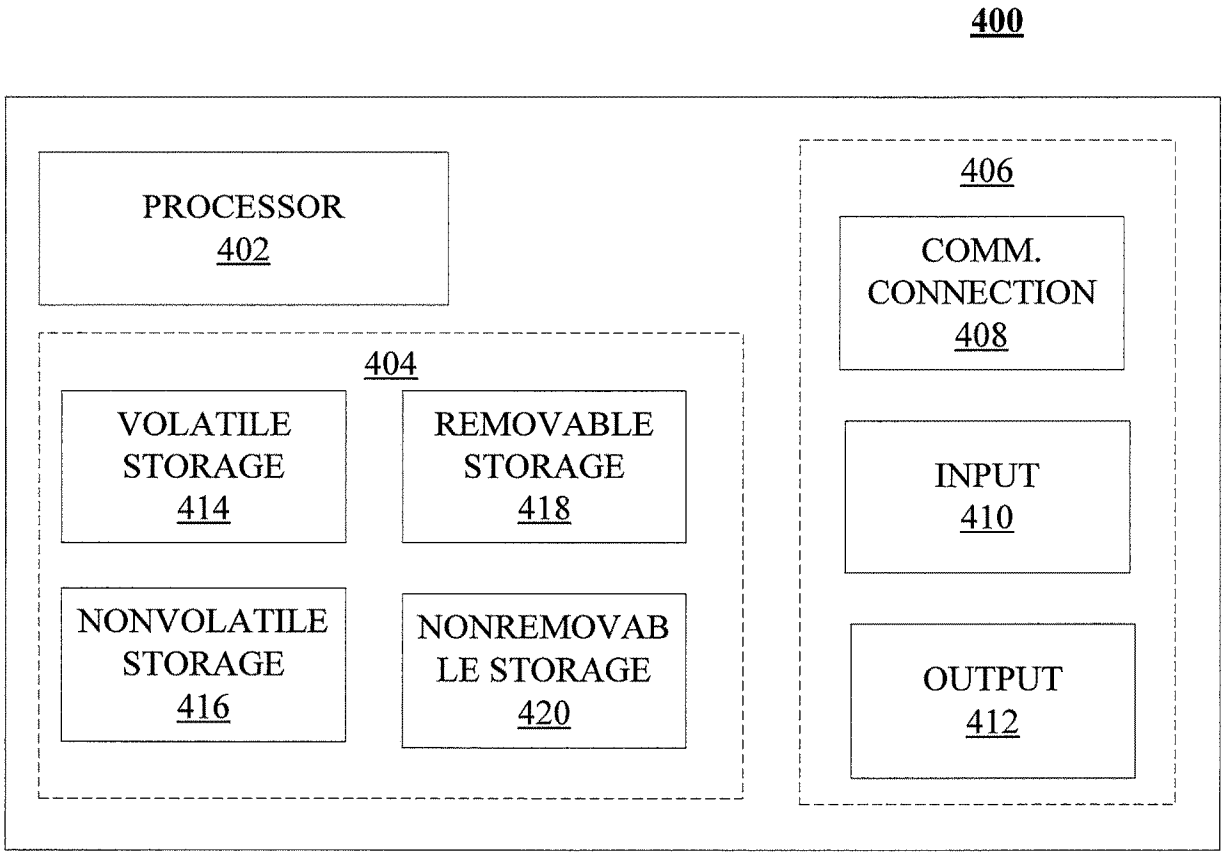
FIG. 4 is a schematic of an exemplary network device.

In this regard, FIG. 4 is a block diagram of network device 400 that may be connected to or comprise a component of cellular network, wireless network, or other network. Network device 400 may comprise hardware or a combination of hardware and software. The functionality to facilitate telecommunications via a telecommunications network may reside in one or combination of network devices 400. Network device 400 depicted in FIG. 4 may represent or perform functionality of an appropriate network device 400, or combination of network devices 400, such as, for example, a component or various components of a cellular broadcast system wireless network, a processor, a server, a gateway, a node, a mobile switching center (MSC), a short message service center (SMSC), an ALFS, a gateway mobile location center (GMLC), a radio access network (RAN), a serving mobile location center (SMLC), or the like, or any appropriate combination thereof. It is emphasized that the block diagram depicted in FIG. 4 is exemplary and not intended to imply a limitation to a specific implementation or configuration. Thus, network device 400 may be implemented in a single device or multiple devices (e.g., single server or multiple servers, single gateway or multiple gateways, single controller or multiple controllers). Multiple network entities may be distributed or centrally located. Multiple network entities may communicate wirelessly, via hard wire, or any appropriate combination thereof.

Network device 400 may comprise a processor 402 and a memory 404 coupled to processor 402. Memory 404 may contain executable instructions that, when executed by processor 402, cause processor 402 to effectuate operations associated with mapping wireless signal strength. As evident from the description herein, network device 400 is not to be construed as software per se.

In addition to processor 402 and memory 404, network device 400 may include an input/output system 406. Processor 402, memory 404, and input/output system 406 may be coupled together (coupling not shown in FIG. 4) to allow communications therebetween. Each portion of network device 400 may comprise circuitry for performing functions associated with each respective portion. Thus, each portion may comprise hardware, or a combination of hardware and software. Accordingly, each portion of network device 400 is not to be construed as software per se. Input/output system 406 may be capable of receiving or providing information from or to a communications device or other network entities configured for telecommunications. For example input/output system 406 may include a wireless communications (e.g., 3G/4G/GPS) card. Input/output system 406 may be capable of receiving or sending video information, audio information, control information, image information, data, or any combination thereof. Input/output system 406 may be capable of transferring information with network device 400. In various configurations, input/output system 406 may receive or provide information via any appropriate means, such as, for example, optical means (e.g., infrared), electromagnetic means (e.g., RF, Wi-Fi, Bluetooth®, ZigBee®), acoustic means (e.g., speaker, microphone, ultrasonic receiver, ultrasonic transmitter), or a combination thereof In an example configuration, input/output system 406 may comprise a Wi-Fi finder, a two-way GPS chipset or equivalent, or the like, or a combination thereof Input/output system 406 of network device 400 also may contain a communication connection 408 that allows network device 400 to communicate with other devices, network entities, or the like. Communication connection 408 may comprise communication media. Communication media typically embody computer-readable instructions, data structures, program modules or other data in a modulated data signal such as a carrier wave or other transport mechanism and includes any information delivery media. By way of example, and not limitation, communication media may include wired media such as a wired network or direct-wired connection, or wireless media such as acoustic, RF, infrared, or other wireless media. The term computer-readable media as used herein includes both storage media and communication media. Input/output system 406 also may include an input device 410 such as keyboard, mouse, pen, voice input device, or touch input device. Input/output system 406 may also include an output device 412, such as a display, speakers, or a printer.

Processor 402 may be capable of performing functions associated with telecommunications, such as functions for processing broadcast messages, as described herein. For example, processor 402 may be capable of, in conjunction with any other portion of network device 400, determining a type of broadcast message and acting according to the broadcast message type or content, as described herein.

Memory 404 of network device 400 may comprise a storage medium having a concrete, tangible, physical structure. As is known, a signal does not have a concrete, tangible, physical structure. Memory 404, as well as any computer-readable storage medium described herein, is not to be construed as a signal. Memory 404, as well as any computer-readable storage medium described herein, is not to be construed as a transient signal. Memory 404, as well as any computer-readable storage medium described herein, is not to be construed as a propagating signal. Memory 404, as well as any computer-readable storage medium described herein, is to be construed as an article of manufacture.

Memory 404 may store any information utilized in conjunction with telecommunications. Depending upon the exact configuration or type of processor, memory 404 may include a volatile storage 414 (such as some types of RAM), a nonvolatile storage 416 (such as ROM, flash memory), or a combination thereof. Memory 404 may include additional storage (e.g., a removable storage 418 or a nonremovable storage 420) including, for example, tape, flash memory, smart cards, CD-ROM, DVD, or other optical storage, magnetic cassettes, magnetic tape, magnetic disk storage or other magnetic storage devices, USB-compatible memory, or any other medium that can be used to store information and that can be accessed by network device 400. Memory 404 may comprise executable instructions that, when executed by processor 402, cause processor 402 to effectuate operations to map signal strengths in an area of interest.

Figure 5:
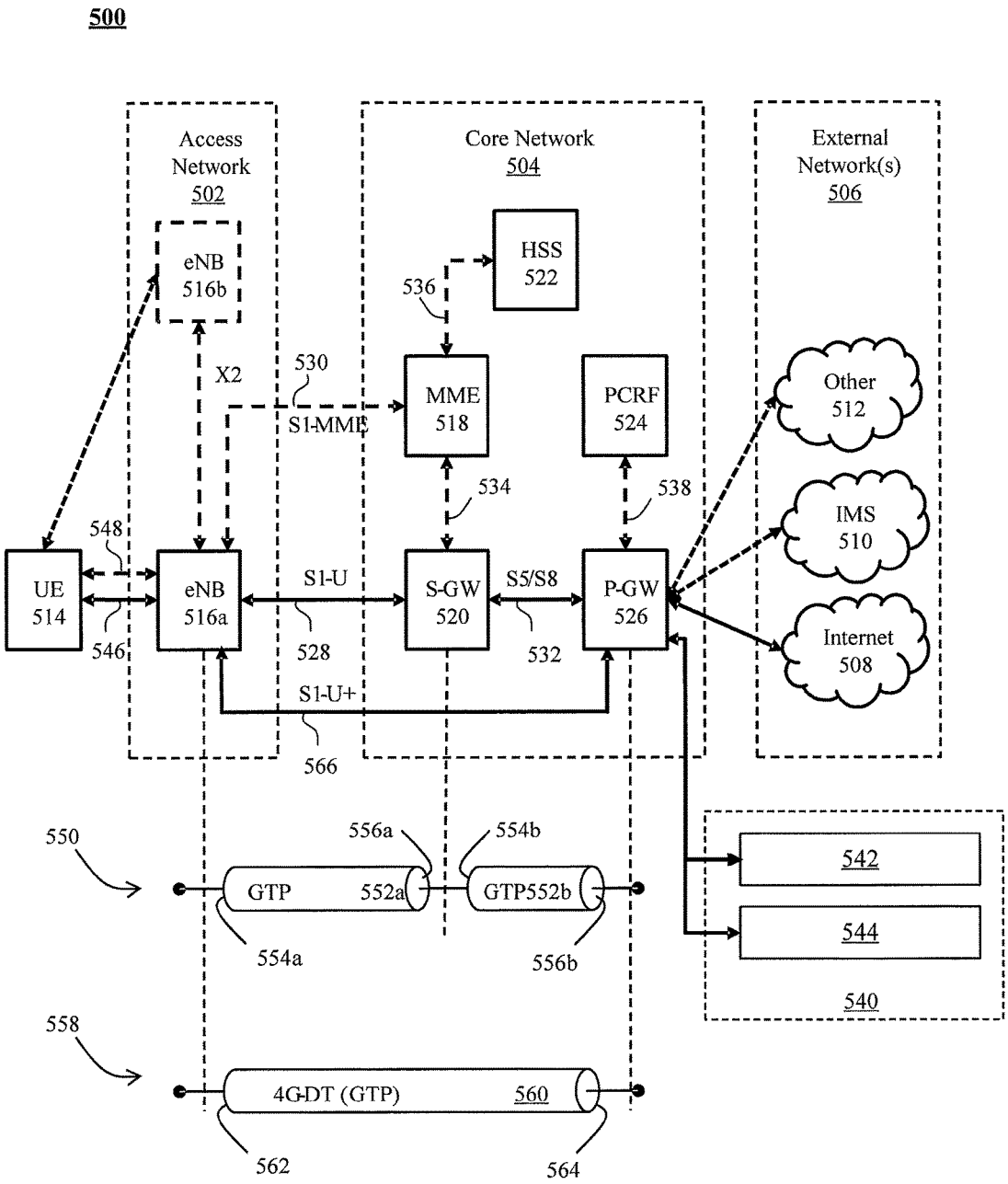
FIG. 5 depicts an exemplary communication system that provide wireless telecommunication services over wireless communication networks.

FIG. 5 illustrates a functional block diagram depicting one example of an LTE-EPS network architecture 500 related to the current disclosure. In particular, the network architecture 500 disclosed herein is referred to as a modified LTE-EPS architecture 500 to distinguish it from a traditional LTE-EPS architecture.

An example modified LTE-EPS architecture 500 is based at least in part on standards developed by the 3rd Generation Partnership Project (3GPP), with information available at www.3gpp.org. In one embodiment, the LTE-EPS network architecture 500 includes an access network 502, a core network 504, e.g., an EPC or Common BackBone (CBB) and one or more external networks 506, sometimes referred to as PDN or peer entities. Different external networks 506 can be distinguished from each other by a respective network identifier, e.g., a label according to DNS naming conventions describing an access point to the PDN. Such labels can be referred to as Access Point Names (APN). External networks 506 can include one or more trusted and non-trusted external networks such as an internet protocol (IP) network 508, an IP multimedia subsystem (IMS) network 510, and other networks 512, such as a service network, a corporate network, or the like.

Access network 502 can include an LTE network architecture sometimes referred to as Evolved Universal mobile Telecommunication system Terrestrial Radio Access (E UTRA) and evolved UMTS Terrestrial Radio Access Network (E-UTRAN). Broadly, access network 502 can include one or more communication devices, commonly referred to as UE 514, and one or more wireless access nodes, or base stations 516*a*, 516*b*. During network operations, at least one base station 516 communicates directly with UE 514. Base station 516 can be an evolved Node B (e-NodeB), with which UE 514 communicates over the air and wirelessly. UEs 514 can include, without limitation, wireless devices, e.g., satellite communication systems, portable digital assistants (PDAs), laptop computers, tablet devices and other mobile devices (e.g., cellular telephones, smart appliances, and so on). UEs 514 can connect to eNBs 516 when UE 514 is within range according to a corresponding wireless communication technology.

UE 514 generally runs one or more applications that engage in a transfer of packets between UE 514 and one or more external networks 506. Such packet transfers can include one of downlink packet transfers from external network 506 to UE 514, uplink packet transfers from UE 514 to external network 506 or combinations of uplink and downlink packet transfers. Applications can include, without limitation, web browsing, VoIP, streaming media and the like. Each application can pose different Quality of Service (QoS) requirements on a respective packet transfer. Different packet transfers can be served by different bearers within core network 504, e.g., according to parameters, such as the QoS.

Core network 504 uses a concept of bearers, e.g., EPS bearers, to route packets, e.g., IP traffic, between a particular gateway in core network 504 and UE 514. A bearer refers generally to an IP packet flow with a defined QoS between the particular gateway and UE 514. Access network 502, e.g., E UTRAN, and core network 504 together set up and release bearers as required by the various applications. Bearers can be classified in at least two different categories: (i) minimum guaranteed bit rate bearers, e.g., for applications, such as VoIP; and (ii) non-guaranteed bit rate bearers that do not require guarantee bit rate, e.g., for applications, such as web browsing.

In one embodiment, the core network 504 includes various network entities, such as MME 518, SGW 520, Home Subscriber Server (HSS) 522, Policy and Charging Rules Function (PCRF) 524 and PGW 526. In one embodiment, MME 518 comprises a control node performing a control signaling between various equipment and devices in access network 502 and core network 504. The protocols running between UE 514 and core network 504 are generally known as Non-Access Stratum (NAS) protocols.

For illustration purposes only, the terms MME 518, SGW 520, HSS 522 and PGW 526, and so on, can be server devices, but may be referred to in the subject disclosure without the word "server." It is also understood that any form of such servers can operate in a device, system, component, or other form of centralized or distributed hardware and software. It is further noted that these terms and other terms such as bearer paths and/or interfaces are terms that can include features, methodologies, and/or fields that may be described in whole or in part by standards bodies such as the 3GPP. It is further noted that some or all embodiments of the subject disclosure may in whole or in part modify, supplement, or otherwise supersede final or proposed standards published and promulgated by 3GPP.

According to traditional implementations of LTE-EPS architectures, SGW 520 routes and forwards all user data packets. SGW 520 also acts as a mobility anchor for user plane operation during handovers between base stations, e.g., during a handover from first eNB 516*a* to second eNB 516*b* as may be the result of UE 514 moving from one area of coverage, e.g., cell, to another. SGW 520 can also terminate a downlink data path, e.g., from external network 506 to UE 514 in an idle state, and trigger a paging operation when downlink data arrives for UE 514. SGW 520 can also be configured to manage and store a context for UE 514, e.g., including one or more of parameters of the IP bearer service and network internal routing information. In addition, SGW 520 can perform administrative functions, e.g., in a visited network, such as collecting information for charging (e.g., the volume of data sent to or received from the user), and/or replicate user traffic, e.g., to support a lawful interception. SGW 520 also serves as the mobility anchor for interworking with other 3GPP technologies such as universal mobile telecommunication system (UMTS).

At any given time, UE 514 is generally in one of three different states: detached, idle, or active. The detached state is typically a transitory state in which UE 514 is powered on but is engaged in a process of searching and registering with network 502. In the active state, UE 514 is registered with access network 502 and has established a wireless connection, e.g., radio resource control (RRC) connection, with eNB 516. Whether UE 514 is in an active state can depend on the state of a packet data session, and whether there is an active packet data session. In the idle state, UE 514 is generally in a power conservation state in which UE 514 typically does not communicate packets. When UE 514 is idle, SGW 520 can terminate a downlink data path, e.g., from one peer entity 506, and triggers paging of UE 514 when data arrives for UE 514. If UE 514 responds to the page, SGW 520 can forward the IP packet to eNB 516*a*.

HSS 522 can manage subscription-related information for a user of UE 514. For example, tHSS 522 can store information such as authorization of the user, security requirements for the user, quality of service (QoS) requirements for the user, etc. HSS 522 can also hold information about external networks 506 to which the user can connect, e.g., in the form of an APN of external networks 506. For example, MME 518 can communicate with HSS 522 to determine if UE 514 is authorized to establish a call, e.g., a voice over IP (VoIP) call before the call is established.

PCRF 524 can perform QoS management functions and policy control. PCRF 524 is responsible for policy control decision-making, as well as for controlling the flow-based charging functionalities in a policy control enforcement function (PCEF), which resides in PGW 526. PCRF 524 provides the QoS authorization, e.g., QoS class identifier and bit rates that decide how a certain data flow will be treated in the PCEF and ensures that this is in accordance with the user's subscription profile.

PGW 526 can provide connectivity between the UE 514 and one or more of the external networks 506. In illustrative network architecture 500, PGW 526 can be responsible for IP address allocation for UE 514, as well as one or more of QoS enforcement and flow-based charging, e.g., according to rules from the PCRF 524. PGW 526 is also typically responsible for filtering downlink user IP packets into the different QoS-based bearers. In at least some embodiments, such filtering can be performed based on traffic flow templates. PGW 526 can also perform QoS enforcement, e.g., for guaranteed bit rate bearers. PGW 526 also serves as a mobility anchor for interworking with non-3GPP technologies such as CDMA2000.

Within access network 502 and core network 504 there may be various bearer paths/interfaces, e.g., represented by solid lines 528 and 530. Some of the bearer paths can be referred to by a specific label. For example, solid line 528 can be considered an S1-U bearer and solid line 532 can be considered an S5/S8 bearer according to LTE-EPS architecture standards. Without limitation, reference to various interfaces, such as S1, X2, S5, S8, S11 refer to EPS interfaces. In some instances, such interface designations are combined with a suffix, e.g., a "U" or a "C" to signify whether the interface relates to a "User plane" or a "Control plane." In addition, the core network 504 can include various signaling bearer paths/interfaces, e.g., control plane paths/interfaces represented by dashed lines 530, 534, 536, and 538. Some of the signaling bearer paths may be referred to by a specific label. For example, dashed line 530 can be considered as an S1-MME signaling bearer, dashed line 534 can be considered as an S11 signaling bearer and dashed line 536 can be considered as an S6a signaling bearer, e.g., according to LTE-EPS architecture standards. The above bearer paths and signaling bearer paths are only illustrated as examples and it should be noted that additional bearer paths and signaling bearer paths may exist that are not illustrated.

Also shown is a novel user plane path/interface, referred to as the S1-U+interface 566. In the illustrative example, the S1-U+ user plane interface extends between the eNB 516*a* and PGW 526. Notably, S1-U+ path/interface does not include SGW 520, a node that is otherwise instrumental in configuring and/or managing packet forwarding between eNB 516*a* and one or more external networks 506 by way of PGW 526. As disclosed herein, the S1-U+ path/interface facilitates autonomous learning of peer transport layer addresses by one or more of the network nodes to facilitate a self-configuring of the packet forwarding path. In particular, such self-configuring can be accomplished during handovers in most scenarios so as to reduce any extra signaling load on the S/PGWs 520, 526 due to excessive handover events.

In some embodiments, PGW 526 is coupled to storage device 540, shown in phantom. Storage device 540 can be integral to one of the network nodes, such as PGW 526, for example, in the form of internal memory and/or disk drive. It is understood that storage device 540 can include registers suitable for storing address values. Alternatively or in addition, storage device 540 can be separate from PGW 526, for example, as an external hard drive, a flash drive, and/or network storage.

Storage device 540 selectively stores one or more values relevant to the forwarding of packet data. For example, storage device 540 can store identities and/or addresses of network entities, such as any of network nodes 518, 520, 522, 524, and 526, eNBs 516 and/or UE 514. In the illustrative example, storage device 540 includes a first storage location 542 and a second storage location 544. First storage location 542 can be dedicated to storing a Currently Used Downlink address value 542. Likewise, second storage location 544 can be dedicated to storing a Default Downlink Forwarding address value 544. PGW 526 can read and/or write values into either of storage locations 542, 544, for example, managing Currently Used Downlink Forwarding address value 542 and Default Downlink Forwarding address value 544 as disclosed herein.

In some embodiments, the Default Downlink Forwarding address for each EPS bearer is the SGW S5-U address for each EPS Bearer. The Currently Used Downlink Forwarding address" for each EPS bearer in PGW 526 can be set every time when PGW 526 receives an uplink packet, e.g., a GTP-U uplink packet, with a new source address for a corresponding EPS bearer. When UE 514 is in an idle state, the "Current Used Downlink Forwarding address" field for each EPS bearer of UE 514 can be set to a "null" or other suitable value.

In some embodiments, the Default Downlink Forwarding address is only updated when PGW 526 receives a new SGW S5-U address in a predetermined message or messages. For example, the Default Downlink Forwarding address is only updated when PGW 526 receives one of a Create Session Request, Modify Bearer Request and Create Bearer Response messages from SGW 520.

As values 542, 544 can be maintained and otherwise manipulated on a per bearer basis, it is understood that the storage locations can take the form of tables, spreadsheets, lists, and/or other data structures generally well understood and suitable for maintaining and/or otherwise manipulate forwarding addresses on a per bearer basis.

It should be noted that access network 502 and core network 504 are illustrated in a simplified block diagram in FIG. 5. In other words, either or both of access network 502 and the core network 504 can include additional network elements that are not shown, such as various routers, switches and controllers. In addition, although FIG. 5 illustrates only a single one of each of the various network elements, it should be noted that access network 502 and core network 504 can include any number of the various network elements. For example, core network 504 can include a pool (i.e., more than one) of MMEs 518, SGWs 520 or PGWs 526.

In the illustrative example, data traversing a network path between UE 514, eNB 516*a*, SGW 520, PGW 526 and external network 506 may be considered to constitute data transferred according to an end-to-end IP service. However, for the present disclosure, to properly perform establishment management in LTE-EPS network architecture 500, the core network, data bearer portion of the end-to-end IP service is analyzed.

An establishment may be defined herein as a connection set up request between any two elements within LTE-EPS network architecture 500. The connection set up request may be for user data or for signaling. A failed establishment may be defined as a connection set up request that was unsuccessful. A successful establishment may be defined as a connection set up request that was successful.

In one embodiment, a data bearer portion comprises a first portion (e.g., a data radio bearer 546) between UE 514 and eNB 516*a*, a second portion (e.g., an S1 data bearer 528) between eNB 516*a* and SGW 520, and a third portion (e.g., an S5/S8 bearer 532) between SGW 520 and PGW 526. Various signaling bearer portions are also illustrated in FIG. 5. For example, a first signaling portion (e.g., a signaling radio bearer 548) between UE 514 and eNB 516*a*, and a second signaling portion (e.g., S1 signaling bearer 530) between eNB 516*a* and MME 518.

In at least some embodiments, the data bearer can include tunneling, e.g., IP tunneling, by which data packets can be forwarded in an encapsulated manner, between tunnel endpoints. Tunnels, or tunnel connections can be identified in one or more nodes of network 500, e.g., by one or more of tunnel endpoint identifiers, an IP address and a user datagram protocol port number. Within a particular tunnel connection, payloads, e.g., packet data, which may or may not include protocol related information, are forwarded between tunnel endpoints.

An example of first tunnel solution 550 includes a first tunnel 552*a* between two tunnel endpoints 554*a* and 556*a*, and a second tunnel 552*b* between two tunnel endpoints 554*b* and 556*b*. In the illustrative example, first tunnel 552*a* is established between eNB 516*a* and SGW 520. Accordingly, first tunnel 552*a* includes a first tunnel endpoint 554*a* corresponding to an S1-U address of eNB 516*a* (referred to herein as the eNB S1-U address), and second tunnel endpoint 556*a* corresponding to an S1-U address of SGW 520 (referred to herein as the SGW S1-U address). Likewise, second tunnel 552*b* includes first tunnel endpoint 554*b* corresponding to an S5-U address of SGW 520 (referred to herein as the SGW S5-U address), and second tunnel endpoint 556*b* corresponding to an S5-U address of PGW 526 (referred to herein as the PGW S5-U address).

In at least some embodiments, first tunnel solution 550 is referred to as a two tunnel solution, e.g., according to the GPRS Tunneling Protocol User Plane (GTPv1-U based), as described in 3GPP specification TS 29.281, incorporated herein in its entirety. It is understood that one or more tunnels are permitted between each set of tunnel end points. For example, each subscriber can have one or more tunnels, e.g., one for each PDP context that they have active, as well as possibly having separate tunnels for specific connections with different quality of service requirements, and so on.

An example of second tunnel solution 558 includes a single or direct tunnel 560 between tunnel endpoints 562 and 564. In the illustrative example, direct tunnel 560 is established between eNB 516*a* and PGW 526, without subjecting packet transfers to processing related to SGW 520. Accordingly, direct tunnel 560 includes first tunnel endpoint 562 corresponding to the eNB S1-U address, and second tunnel endpoint 564 corresponding to the PGW S5-U address. Packet data received at either end can be encapsulated into a payload and directed to the corresponding address of the other end of the tunnel. Such direct tunneling avoids processing, e.g., by SGW 520 that would otherwise relay packets between the same two endpoints, e.g., according to a protocol, such as the GTP-U protocol.

In some scenarios, direct tunneling solution 558 can forward user plane data packets between eNB 516*a* and PGW 526, by way of SGW 520. That is, SGW 520 can serve a relay function, by relaying packets between two tunnel endpoints 516*a*, 526. In other scenarios, direct tunneling solution 558 can forward user data packets between eNB 516*a* and PGW 526, by way of the S1 U+ interface, thereby bypassing SGW 520.

Generally, UE 514 can have one or more bearers at any one time. The number and types of bearers can depend on applications, default requirements, and so on. It is understood that the techniques disclosed herein, including the configuration, management and use of various tunnel solutions 550, 558, can be applied to the bearers on an individual bases. That is, if user data packets of one bearer, say a bearer associated with a VoIP service of UE 514, then the forwarding of all packets of that bearer are handled in a similar manner. Continuing with this example, the same UE 514 can have another bearer associated with it through the same eNB 516*a*. This other bearer, for example, can be associated with a relatively low rate data session forwarding user data packets through core network 504 simultaneously with the first bearer. Likewise, the user data packets of the other bearer are also handled in a similar manner, without necessarily following a forwarding path or solution of the first bearer. Thus, one of the bearers may be forwarded through direct tunnel 558; whereas, another one of the bearers may be forwarded through a two-tunnel solution 550.

Figure 6:
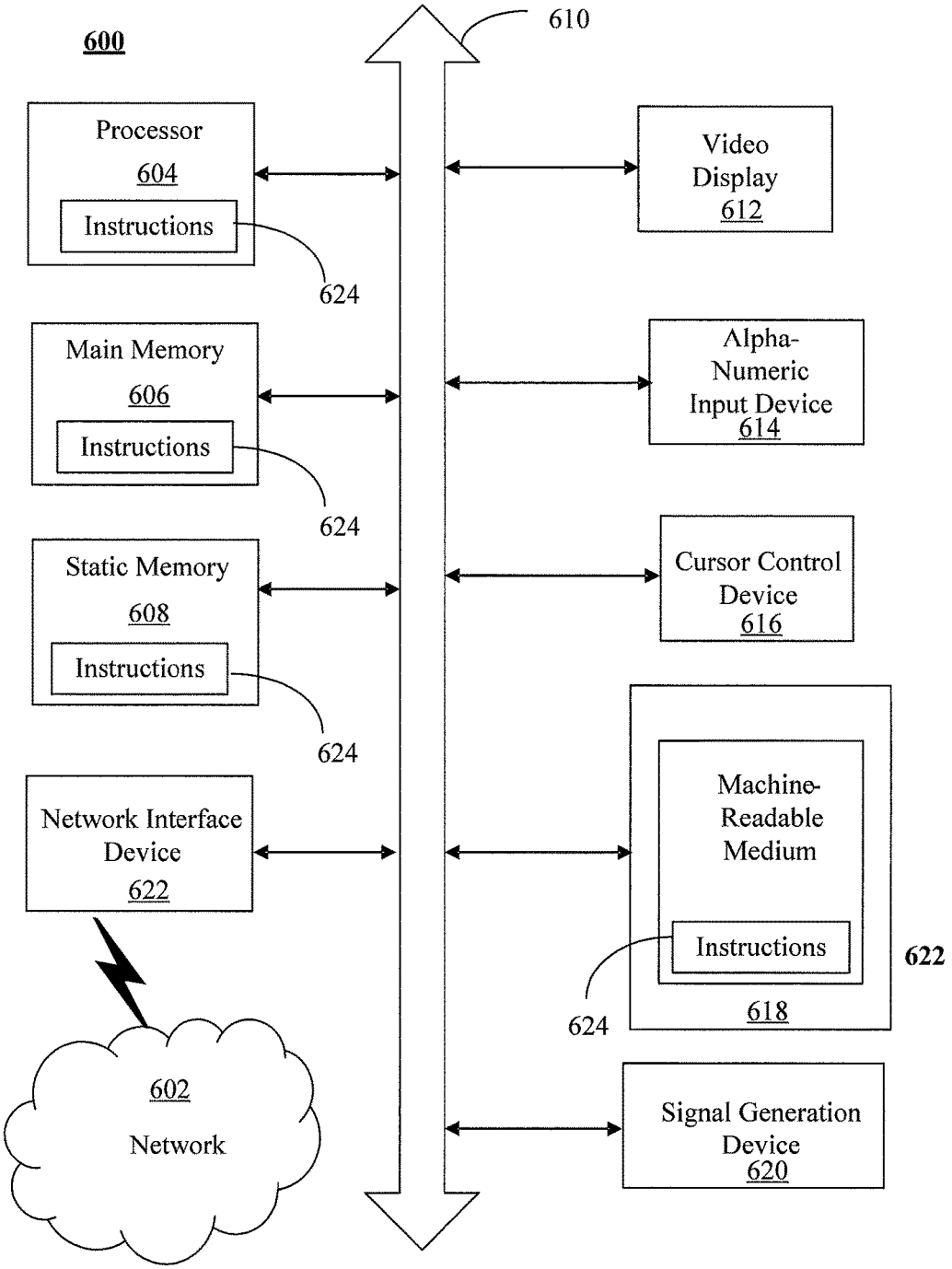
FIG. 6 depicts an exemplary communication system that provide wireless telecommunication services over wireless communication networks.

FIG. 6 depicts an exemplary diagrammatic representation of a machine in the form of a computer system 600 within which a set of instructions, when executed, may cause the machine to perform any one or more of the methods described above. One or more instances of the machine can operate, for example, as processor 302, UE 414, eNB 416, MME 418, SGW 420, HSS 422, PCRF 424, PGW 426 and other devices of FIGS. 1, 2, and 4. In some embodiments, the machine may be connected (e.g., using a network 602) to other machines. In a networked deployment, the machine may operate in the capacity of a server or a client user machine in a server-client user network environment, or as a peer machine in a peer-to-peer (or distributed) network environment.

The machine may comprise a server computer, a client user computer, a personal computer (PC), a tablet, a smart phone, a laptop computer, a desktop computer, a control system, a network router, switch or bridge, or any machine capable of executing a set of instructions (sequential or otherwise) that specify actions to be taken by that machine. It will be understood that a communication device of the subject disclosure includes broadly any electronic device that provides voice, video or data communication. Further, while a single machine is illustrated, the term "machine" shall also be taken to include any collection of machines that individually or jointly execute a set (or multiple sets) of instructions to perform any one or more of the methods discussed herein.

Computer system 600 may include a processor (or controller) 604 (e.g., a central processing unit (CPU)), a graphics processing unit (GPU, or both), a main memory 606 and a static memory 608, which communicate with each other via a bus 610. The computer system 600 may further include a display unit 612 (e.g., a liquid crystal display (LCD), a flat panel, or a solid state display). Computer system 600 may include an input device 614 (e.g., a keyboard), a cursor control device 616 (e.g., a mouse), a disk drive unit 618, a signal generation device 620 (e.g., a speaker or remote control) and a network interface device 622. In distributed environments, the embodiments described in the subject disclosure can be adapted to utilize multiple display units 612 controlled by two or more computer systems 600. In this configuration, presentations described by the subject disclosure may in part be shown in a first of display units 612, while the remaining portion is presented in a second of display units 612.

The disk drive unit 618 may include a tangible computer-readable storage medium 624 on which is stored one or more sets of instructions (e.g., software 626) embodying any one or more of the methods or functions described herein, including those methods illustrated above. Instructions 626 may also reside, completely or at least partially, within main memory 606, static memory 608, or within processor 604 during execution thereof by the computer system 600. Main memory 606 and processor 604 also may constitute tangible computer-readable storage media.

Figure 7:
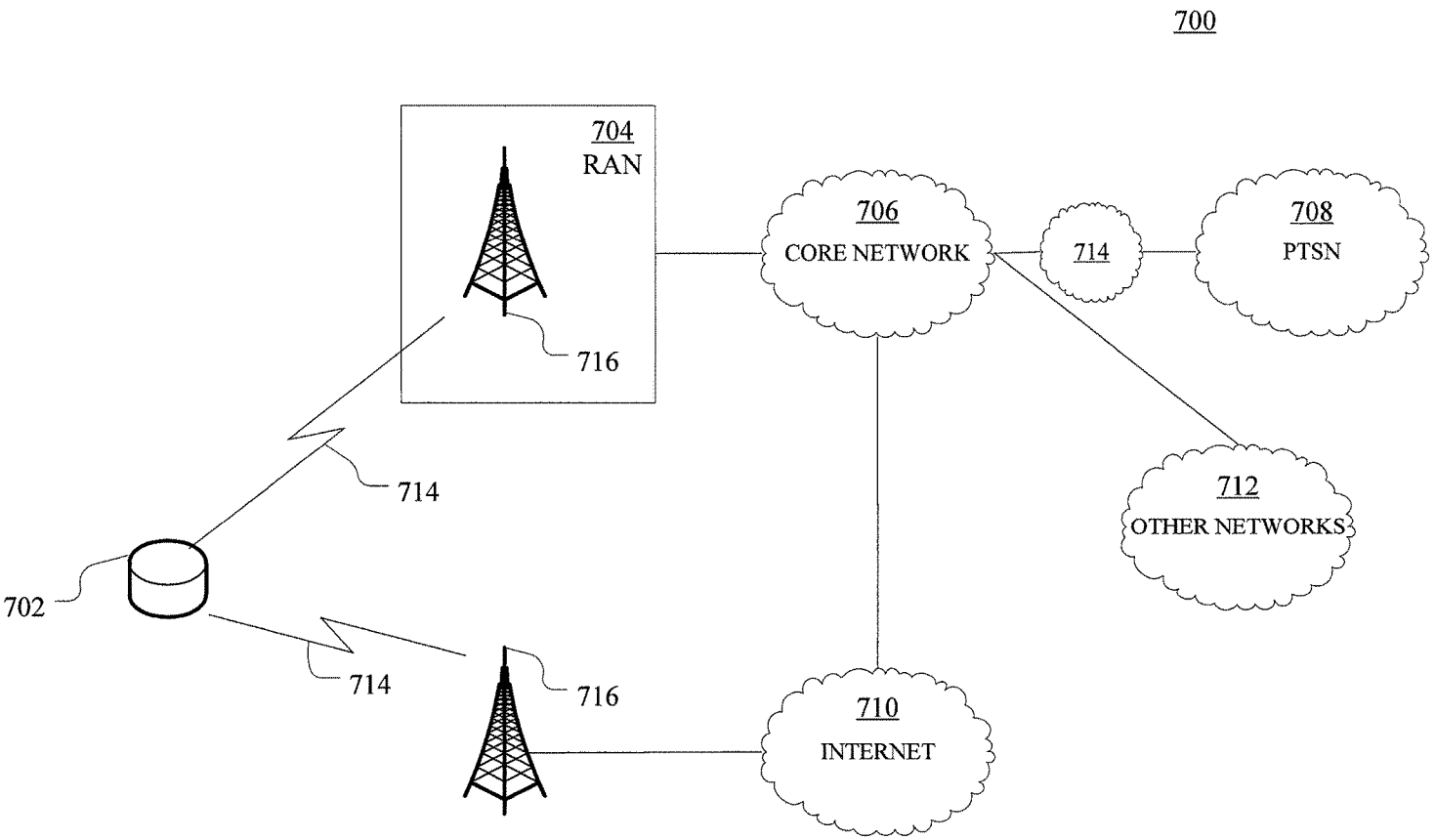
FIG. 7 is a diagram of an exemplary telecommunications system in which the disclosed methods and processes may be implemented.

As shown in FIG. 7, telecommunication system 700 may include wireless transmit/receive units (WTRUs) 702, a RAN 704, a core network 706, a public switched telephone network (PSTN) 708, the Internet 710, or other networks 712, though it will be appreciated that the disclosed examples contemplate any number of WTRUs, base stations, networks, or network elements. Each WTRU 702 may be any type of device configured to operate or communicate in a wireless environment. For example, a WTRU may comprise a mobile device, network device 400, or the like, or any combination thereof. By way of example, WTRUs 702 may be configured to transmit or receive wireless signals and may include a UE, a mobile station, a mobile device, a fixed or mobile subscriber unit, a pager, a cellular telephone, a PDA, a smartphone, a laptop, a netbook, a personal computer, a wireless sensor, consumer electronics, or the like. WTRUs 702 may be configured to transmit or receive wireless signals over an air interface 714.

Telecommunication system 700 may also include one or more base stations 716. Each of base stations 716 may be any type of device configured to wirelessly interface with at least one of the WTRUs 702 to facilitate access to one or more communication networks, such as core network 706, PTSN 708, Internet 710, or other networks 712. By way of example, base stations 716 may be a base transceiver station (BTS), a Node-B, an eNode B, a Home Node B, a Home eNode B, a site controller, an access point (AP), a wireless router, or the like. While base stations 716 are each depicted as a single element, it will be appreciated that base stations 716 may include any number of interconnected base stations or network elements.

RAN 704 may include one or more base stations 716, along with other network elements (not shown), such as a base station controller (BSC), a radio network controller (RNC), or relay nodes. One or more base stations 716 may be configured to transmit or receive wireless signals within a particular geographic region, which may be referred to as a cell (not shown). The cell may further be divided into cell sectors. For example, the cell associated with base station 716 may be divided into three sectors such that base station 716 may include three transceivers: one for each sector of the cell. In another example, base station 716 may employ multiple-input multiple-output (MIMO) technology and, therefore, may utilize multiple transceivers for each sector of the cell.

Base stations 716 may communicate with one or more of WTRUs 702 over air interface 714, which may be any suitable wireless communication link (e.g., RF, microwave, infrared (IR), ultraviolet (UV), or visible light). Air interface 714 may be established using any suitable radio access technology (RAT).

More specifically, as noted above, telecommunication system 700 may be a multiple access system and may employ one or more channel access schemes, such as CDMA, TDMA, FDMA, OFDMA, SC-FDMA, or the like. For example, base station 716 in RAN 704 and WTRUs 702 connected to RAN 704 may implement a radio technology such as Universal Mobile Telecommunications System (UMTS) Terrestrial Radio Access (UTRA) that may establish air interface 714 using wideband CDMA (WCDMA). WCDMA may include communication protocols, such as High-Speed Packet Access (HSPA) or Evolved HSPA (HSPA+). HSPA may include High-Speed Downlink Packet Access (HSDPA) or High-Speed Uplink Packet Access (HSUPA).

As another example base station 716 and WTRUs 702 that are connected to RAN 704 may implement a radio technology such as Evolved UMTS Terrestrial Radio Access (E-UTRA), which may establish air interface 714 using LTE or LTE-Advanced (LTE-A).

Optionally base station 716 and WTRUs 702 connected to RAN 704 may implement radio technologies such as IEEE 602.16 (i.e., Worldwide Interoperability for Microwave Access (WiMAX)), CDMA2000, CDMA2000 1X, CDMA2000 EV-DO, Interim Standard 2000 (IS-2000), Interim Standard 95 (IS-95), Interim Standard 856 (IS-856), GSM, Enhanced Data rates for GSM Evolution (EDGE), GSM EDGE (GERAN), or the like.

Base station 716 may be a wireless router, Home Node B, Home eNode B, or access point, for example, and may utilize any suitable RAT for facilitating wireless connectivity in a localized area, such as a place of business, a home, a vehicle, a campus, or the like. For example, base station 716 and associated WTRUs 702 may implement a radio technology such as IEEE 602.11 to establish a wireless local area network (WLAN). As another example, base station 716 and associated WTRUs 702 may implement a radio technology such as IEEE 602.15 to establish a wireless personal area network (WPAN). In yet another example, base station 716 and associated WTRUs 702 may utilize a cellular-based RAT (e.g., WCDMA, CDMA2000, GSM, LTE, LTE-A, etc.) to establish a picocell or femtocell. As shown in FIG. 7, base station 716 may have a direct connection to Internet 710. Thus, base station 716 may not be required to access Internet 710 via core network 706.

RAN 704 may be in communication with core network 706, which may be any type of network configured to provide voice, data, applications, and/or voice over internet protocol (VoIP) services to one or more WTRUs 702. For example, core network 706 may provide call control, billing services, mobile location-based services, pre-paid calling, Internet connectivity, video distribution or high-level security functions, such as user authentication. Although not shown in FIG. 7, it will be appreciated that RAN 704 or core network 706 may be in direct or indirect communication with other RANs that employ the same RAT as RAN 704 or a different RAT. For example, in addition to being connected to RAN 704, which may be utilizing an E-UTRA radio technology, core network 706 may also be in communication with another RAN (not shown) employing a GSM radio technology.

Core network 706 may also serve as a gateway for WTRUs 702 to access PSTN 708, Internet 710, or other networks 712. PSTN 708 may include circuit-switched telephone networks that provide plain old telephone service (POTS). For LTE core networks, core network 706 may use IMS core 714 to provide access to PSTN 708. Internet 710 may include a global system of interconnected computer networks or devices that use common communication protocols, such as the transmission control protocol (TCP), user datagram protocol (UDP), or IP in the TCP/IP internet protocol suite. Other networks 712 may include wired or wireless communications networks owned or operated by other service providers. For example, other networks 712 may include another core network connected to one or more RANs, which may employ the same RAT as RAN 704 or a different RAT.

Some or all WTRUs 702 in telecommunication system 700 may include multi-mode capabilities. That is, WTRUs 702 may include multiple transceivers for communicating with different wireless networks over different wireless links. For example, one or more WTRUs 702 may be configured to communicate with base station 716, which may employ a cellular-based radio technology, and with base station 716, which may employ an IEEE 802 radio technology.

Figure 8:
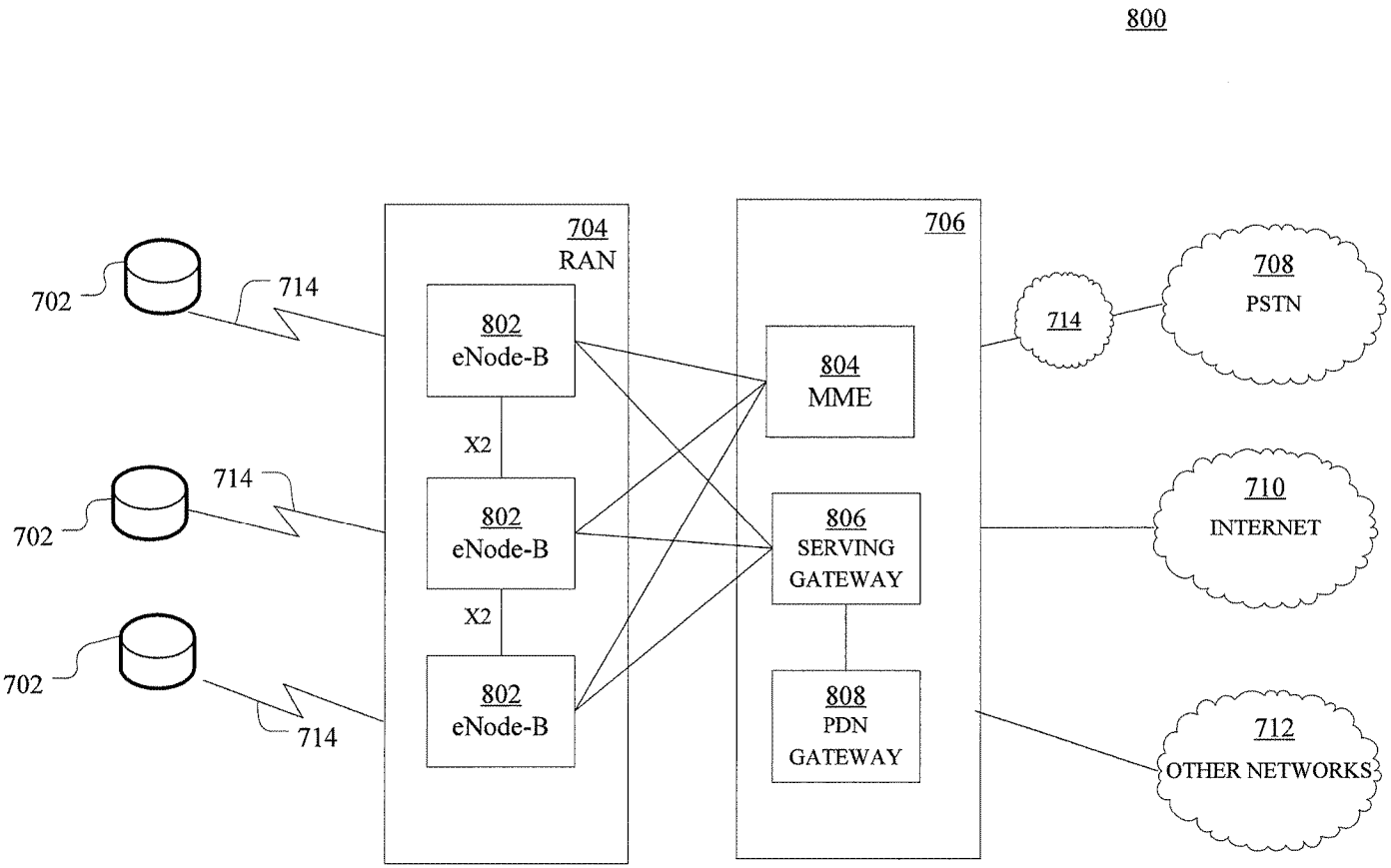
FIG. 8 is an example system diagram of a radio access network and a core network.

FIG. 8 is an example system 800 including RAN 704 and core network 706. As noted above, RAN 704 may employ an E-UTRA radio technology to communicate with WTRUs 702 over air interface 714. RAN 704 may also be in communication with core network 706.

RAN 704 may include any number of eNode-Bs 802 while remaining consistent with the disclosed technology. One or more eNode-Bs 802 may include one or more transceivers for communicating with the WTRUs 702 over air interface 714. Optionally, eNode-Bs 802 may implement MIMO technology. Thus, one of eNode-Bs 802, for example, may use multiple antennas to transmit wireless signals to, or receive wireless signals from, one of WTRUs 702.

Each of eNode-Bs 802 may be associated with a particular cell (not shown) and may be configured to handle radio resource management decisions, handover decisions, scheduling of users in the uplink or downlink, or the like. As shown in FIG. 8 eNode-Bs 802 may communicate with one another over an X2 interface.

Core network 706 shown in FIG. 8 may include a mobility management gateway or entity (MME) 804, a serving gateway 806, or a packet data network (PDN) gateway 808. While each of the foregoing elements are depicted as part of core network 706, it will be appreciated that any one of these elements may be owned or operated by an entity other than the core network operator.

MME 804 may be connected to each of eNode-Bs 802 in RAN 704 via an S1 interface and may serve as a control node. For example, MME 804 may be responsible for authenticating users of WTRUs 702, bearer activation or deactivation, selecting a particular serving gateway during an initial attach of WTRUs 702, or the like. MIME 804 may also provide a control plane function for switching between RAN 704 and other RANs (not shown) that employ other radio technologies, such as GSM or WCDMA.

Serving gateway 806 may be connected to each of eNode-Bs 802 in RAN 704 via the S1 interface. Serving gateway 806 may generally route or forward user data packets to or from the WTRUs 702. Serving gateway 806 may also perform other functions, such as anchoring user planes during inter-eNode B handovers, triggering paging when downlink data is available for WTRUs 702, managing or storing contexts of WTRUs 702, or the like.

Serving gateway 806 may also be connected to PDN gateway 808, which may provide WTRUs 702 with access to packet-switched networks, such as Internet 710, to facilitate communications between WTRUs 702 and IP-enabled devices.

Core network 706 may facilitate communications with other networks. For example, core network 706 may provide WTRUs 702 with access to circuit-switched networks, such as PSTN 708, such as through IMS core 714, to facilitate communications between WTRUs 702 and traditional land-line communications devices. In addition, core network 706 may provide the WTRUs 702 with access to other networks 712, which may include other wired or wireless networks that are owned or operated by other service providers.

Figure 9:
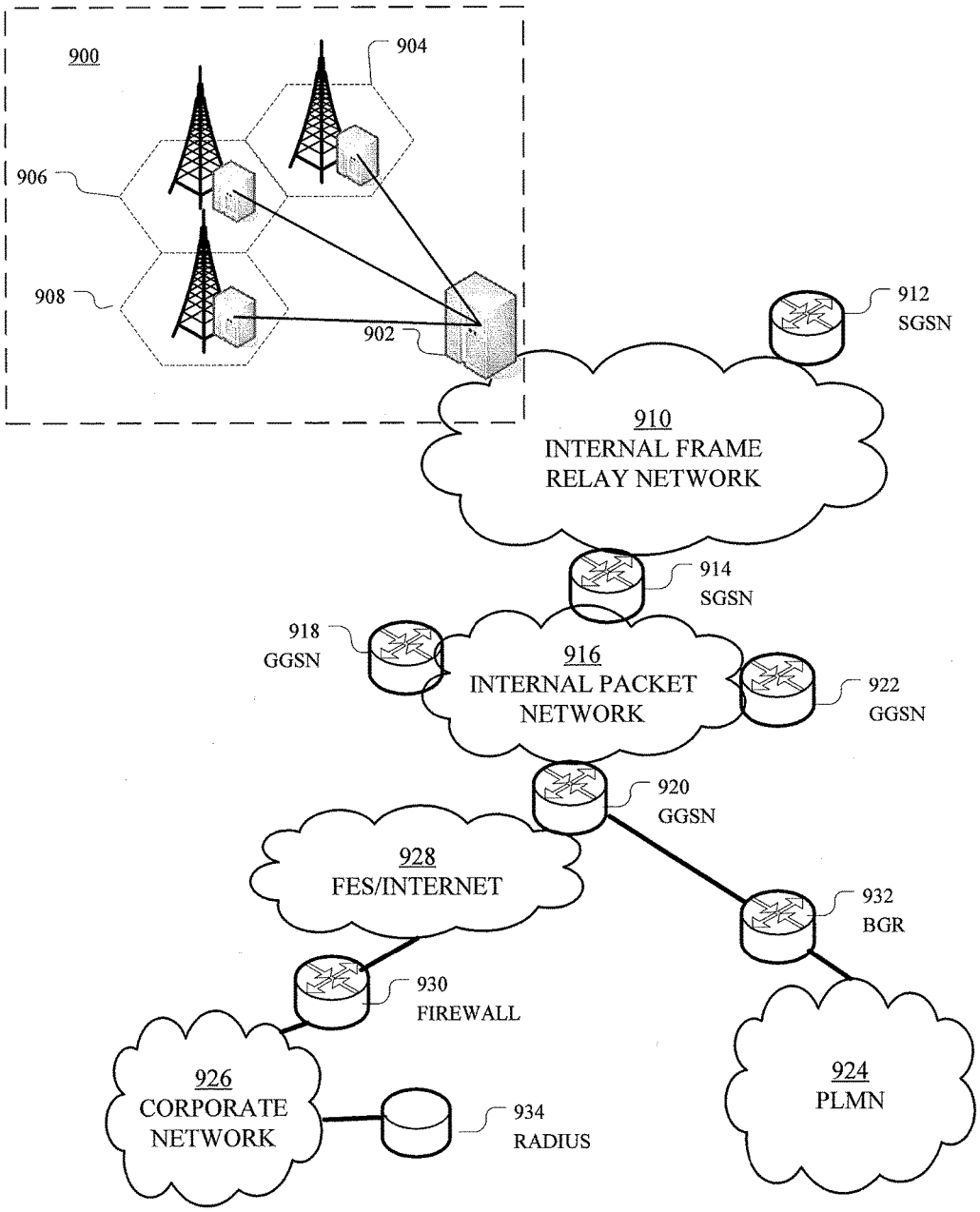
FIG. 9 depicts an overall block diagram of an example packet-based mobile cellular network environment, such as a general packet radio service (GPRS) network.

FIG. 9 depicts an overall block diagram of an example packet-based mobile cellular network environment, such as a GPRS network as described herein. In the example packet-based mobile cellular network environment shown in FIG. 9, there are a plurality of base station subsystems (BSS) 900 (only one is shown), each of which comprises a base station controller (BSC) 902 serving a plurality of BTSs, such as BTSs 904, 906, 908. BTSs 904, 906, 908 are the access points where users of packet-based mobile devices become connected to the wireless network. In example fashion, the packet traffic originating from mobile devices is transported via an over-the-air interface to BTS 908, and from BTS 908 to BSC 902. Base station subsystems, such as BSS 900, are a part of internal frame relay network 910 that can include a service GPRS support nodes (SGSN), such as SGSN 912 or SGSN 914. Each SGSN 912, 914 is connected to an internal packet network 916 through which SGSN 912, 914 can route data packets to or from a plurality of gateway GPRS support nodes (GGSN) 918, 920, 922. As illustrated, SGSN 914 and GGSNs 918, 920, 922 are part of internal packet network 916. GGSNs 918, 920, 922 mainly provide an interface to external IP networks such as PLMN 924, corporate intranets/internets 926, or Fixed-End System (FES) or the public Internet 928. As illustrated, subscriber corporate network 926 may be connected to GGSN 920 via a firewall 930. PLMN 924 may be connected to GGSN 920 via a boarder gateway router (BGR) 932. A Remote Authentication Dial-In User Service (RADIUS) server 934 may be used for caller authentication when a user calls corporate network 926.

Generally, there may be a several cell sizes in a network, referred to as macro, micro, pico, femto or umbrella cells. The coverage area of each cell is different in different environments. Macro cells can be regarded as cells in which the base station antenna is installed in a mast or a building above average roof top level. Micro cells are cells whose antenna height is under average roof top level. Micro cells are typically used in urban areas. Pico cells are small cells having a diameter of a few dozen meters. Pico cells are used mainly indoors. Femto cells have the same size as pico cells, but a smaller transport capacity. Femto cells are used indoors, in residential or small business environments. On the other hand, umbrella cells are used to cover shadowed regions of smaller cells and fill in gaps in coverage between those cells.

Figure 10:
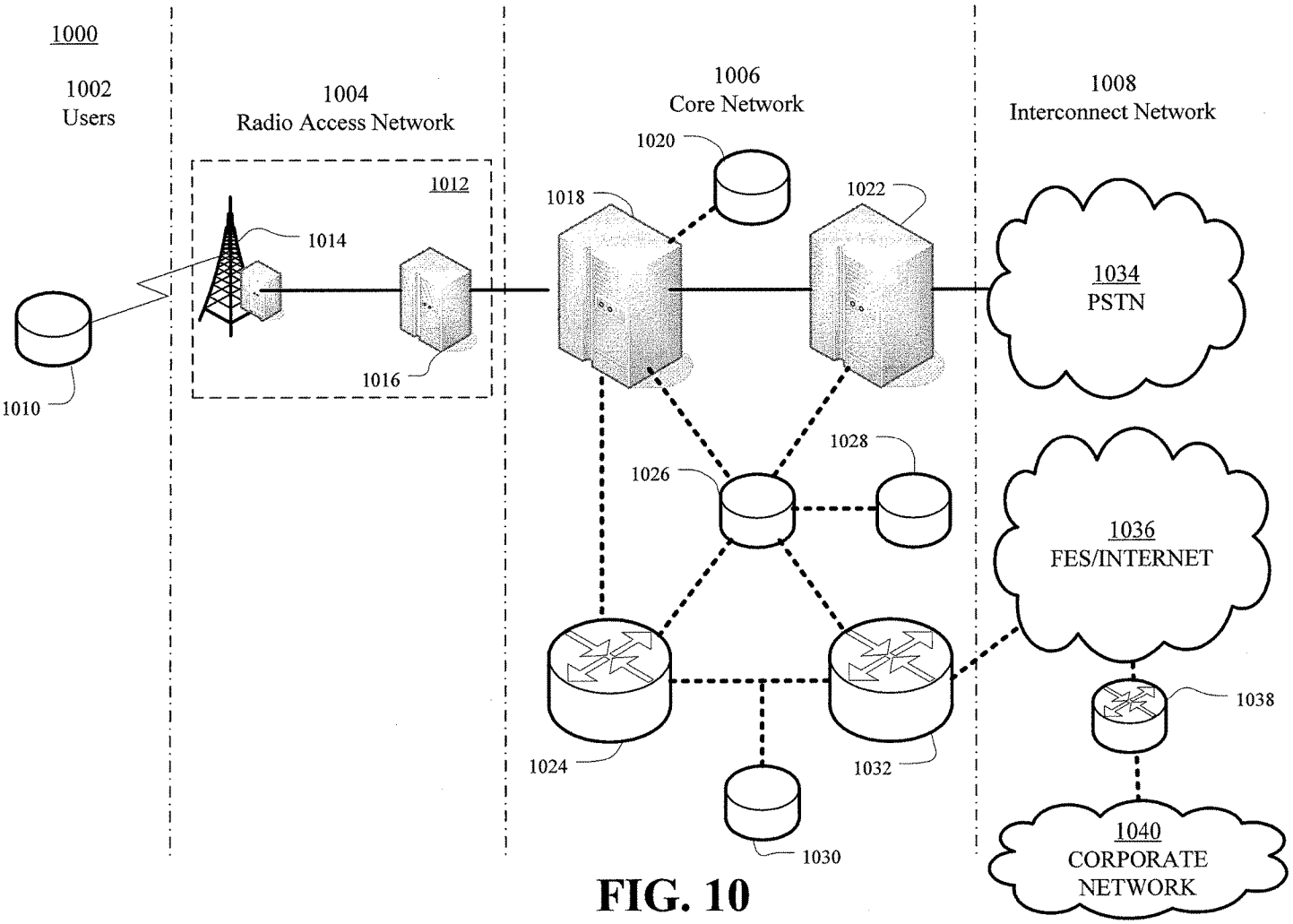
FIG. 10 illustrates an exemplary architecture of a GPRS network.

FIG. 10 illustrates an architecture of a typical GPRS network 1000 as described herein. The architecture depicted in FIG. 10 may be segmented into four groups: users 1002, RAN 1004, core network 1006, and interconnect network 1008. Users 1002 comprise a plurality of end users, who each may use one or more devices 1010. Note that device 1010 is referred to as a mobile subscriber (MS) in the description of network shown in FIG. 10. In an example, device 1010 comprises a communications device (e.g., mobile device 102, mobile positioning center 116, network device 300, any of detected devices 500, second device 508, access device 604, access device 606, access device 608, access device 610 or the like, or any combination thereof). Radio access network 1004 comprises a plurality of BSSs such as BSS 1012, which includes a BTS 1014 and a BSC 1016. Core network 1006 may include a host of various network elements. As illustrated in FIG. 10, core network 1006 may comprise MSC 1018, service control point (SCP) 1020, gateway MSC (GMSC) 1022, SGSN 1024, home location register (HLR) 1026, authentication center (AuC) 1028, domain name system (DNS) server 1030, and GGSN 1032. Interconnect network 1008 may also comprise a host of various networks or other network elements. As illustrated in FIG. 10, interconnect network 1008 comprises a PSTN 1034, an FES/Internet 1036, a firewall 1038, or a corporate network 1040.

An MSC can be connected to a large number of BSCs. At MSC 1018, for instance, depending on the type of traffic, the traffic may be separated in that voice may be sent to PSTN 1034 through GMSC 1022, or data may be sent to SGSN 1024, which then sends the data traffic to GGSN 1032 for further forwarding.

When MSC 1018 receives call traffic, for example, from BSC 1016, it sends a query to a database hosted by SCP 1020, which processes the request and issues a response to MSC 1018 so that it may continue call processing as appropriate.

HLR 1026 is a centralized database for users to register to the GPRS network. HLR 1026 stores static information about the subscribers such as the International Mobile Subscriber Identity (IMSI), subscribed services, or a key for authenticating the subscriber. HLR 1026 also stores dynamic subscriber information such as the current location of the MS. Associated with HLR 1026 is AuC 1028, which is a database that contains the algorithms for authenticating subscribers and includes the associated keys for encryption to safeguard the user input for authentication.

In the following, depending on context, "mobile subscriber" or "MS" sometimes refers to the end user and sometimes to the actual portable device, such as a mobile device, used by an end user of the mobile cellular service. When a mobile subscriber turns on his or her mobile device, the mobile device goes through an attach process by which the mobile device attaches to an SGSN of the GPRS network. In FIG. 10, when MS 1010 initiates the attach process by turning on the network capabilities of the mobile device, an attach request is sent by MS 1010 to SGSN 1024. The SGSN 1024 queries another SGSN, to which MS 1010 was attached before, for the identity of MS 1010. Upon receiving the identity of MS 1010 from the other SGSN, SGSN 1024 requests more information from MS 1010. This information is used to authenticate MS 1010 together with the information provided by HLR 1026. Once verified, SGSN 1024 sends a location update to HLR 1026 indicating the change of location to a new SGSN, in this case SGSN 1024. HLR 1026 notifies the old SGSN, to which MS 1010 was attached before, to cancel the location process for MS 1010. HLR 1026 then notifies SGSN 1024 that the location update has been performed. At this time, SGSN 1024 sends an Attach Accept message to MS 1010, which in turn sends an Attach Complete message to SGSN 1024.

Next, MS 1010 establishes a user session with the destination network, corporate network 1040, by going through a Packet Data Protocol (PDP) activation process. Briefly, in the process, MS 1010 requests access to the Access Point Name (APN), for example, UPS.com, and SGSN 1024 receives the activation request from MS 1010. SGSN 1024 then initiates a DNS query to learn which GGSN 1032 has access to the UPS.com APN. The DNS query is sent to a DNS server within core network 1006, such as DNS server 1030, which is provisioned to map to one or more GGSNs in core network 1006. Based on the APN, the mapped GGSN 1032 can access requested corporate network 1040. SGSN 1024 then sends to GGSN 1032 a Create PDP Context Request message that contains necessary information. GGSN 1032 sends a Create PDP Context Response message to SGSN 1024, which then sends an Activate PDP Context Accept message to MS 1010.

Once activated, data packets of the call made by MS 1010 can then go through RAN 1004, core network 1006, and interconnect network 1008, in a particular FES/Internet 1036 and firewall 1038, to reach corporate network 1040.

Figure 11:
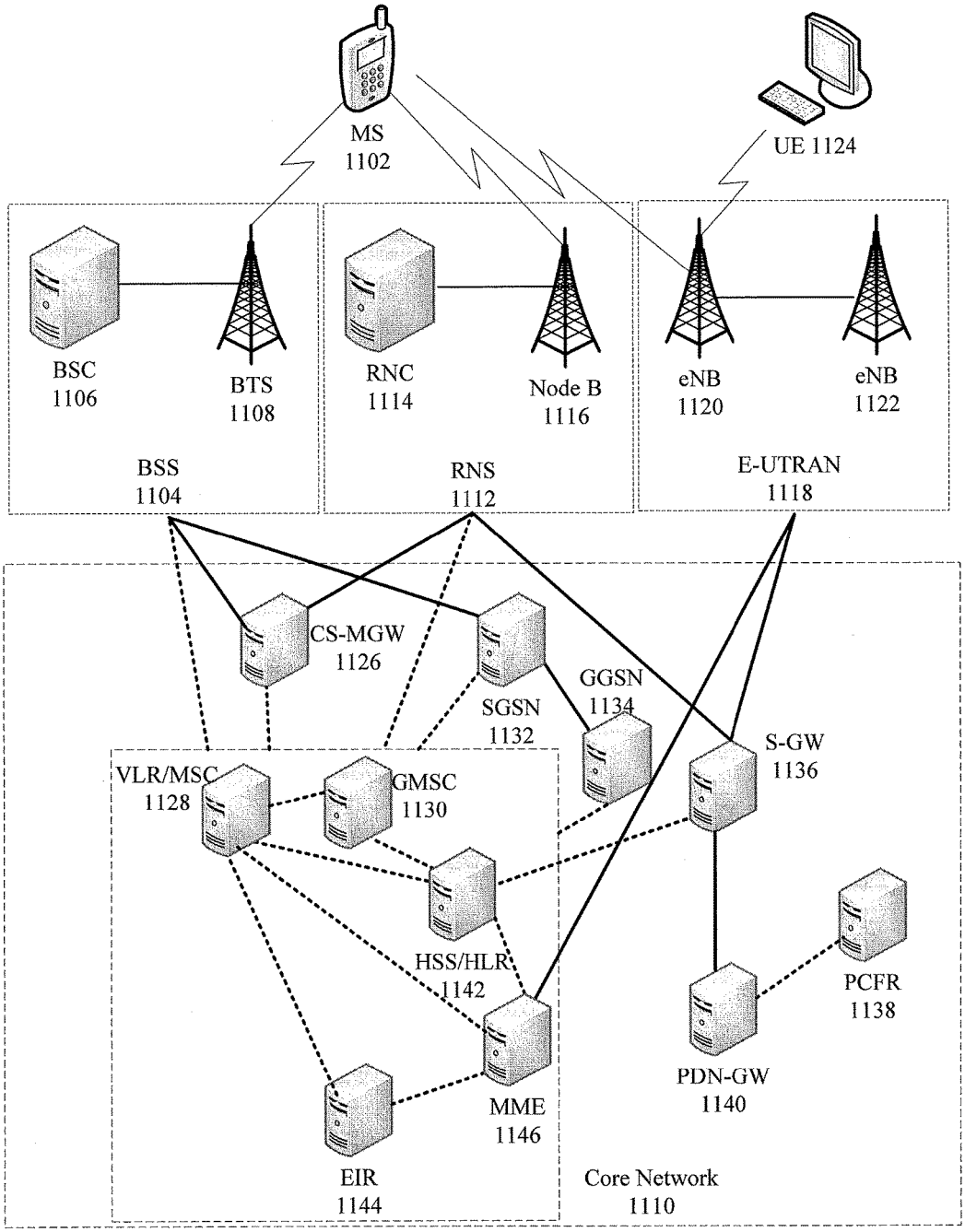
FIG. 11 is a block diagram of an exemplary public land mobile network (PLMN).

FIG. 11 illustrates a PLMN block diagram view of an example architecture that may be replaced by a telecommunications system. In FIG. 11, solid lines may represent user traffic signals, and dashed lines may represent support signaling. MS 1102 is the physical equipment used by the PLMN subscriber. For example, network device 400, the like, or any combination thereof may serve as MS 1102. MS 1102 may be one of, but not limited to, a cellular telephone, a cellular telephone in combination with another electronic device or any other wireless mobile communication device.

MS 1102 may communicate wirelessly with BSS 1104. BSS 1104 contains BSC 1106 and a BTS 1108. BSS 1104 may include a single BSC 1106/BTS 1108 pair (base station) or a system of BSC/BTS pairs that are part of a larger network. BSS 1104 is responsible for communicating with MS 1102 and may support one or more cells. BSS 1104 is responsible for handling cellular traffic and signaling between MS 1102 and a core network 1110. Typically, BSS 1104 performs functions that include, but are not limited to, digital conversion of speech channels, allocation of channels to mobile devices, paging, or transmission/reception of cellular signals.

Additionally, MS 1102 may communicate wirelessly with RNS 1112. RNS 1112 contains a Radio Network Controller (RNC) 1114 and one or more Nodes B 1116. RNS 1112 may support one or more cells. RNS 1112 may also include one or more RNC 1114/Node B 1116 pairs or alternatively a single RNC 1114 may manage multiple Nodes B 1116. RNS 1112 is responsible for communicating with MS 1102 in its geographically defined area. RNC 1114 is responsible for controlling Nodes B 1116 that are connected to it and is a control element in a UMTS radio access network. RNC 1114 performs functions such as, but not limited to, load control, packet scheduling, handover control, security functions, or controlling MS 1102 access to core network 1110.

An E-UTRA Network (E-UTRAN) 1118 is a RAN that provides wireless data communications for MS 1102 and UE 1124. E-UTRAN 1118 provides higher data rates than traditional UMTS. It is part of the LTE upgrade for mobile networks, and later releases meet the requirements of the International Mobile Telecommunications (IMT) Advanced and are commonly known as a 4G networks. E-UTRAN 1118 may include of series of logical network components such as E-UTRAN Node B (eNB) 1120 and E-UTRAN Node B (eNB) 1122. E-UTRAN 1118 may contain one or more eNBs. User equipment (UE) 1124 may be any mobile device capable of connecting to E-UTRAN 1118 including, but not limited to, a personal computer, laptop, mobile device, wireless router, or other device capable of wireless connectivity to E-UTRAN 1118. The improved performance of the E-UTRAN 1118 relative to a typical UMTS network allows for increased bandwidth, spectral efficiency, and functionality including, but not limited to, voice, high-speed applications, large data transfer or IPTV, while still allowing for full mobility.

Typically MS 1102 may communicate with any or all of BSS 1104, RNS 1112, or E-UTRAN 1118. Ina illustrative system, each of BSS 1104, RNS 1112, and E-UTRAN 1118 may provide MS 1102 with access to core network 1110. Core network 1110 may include of a series of devices that route data and communications between end users. Core network 1110 may provide network service functions to users in the circuit switched (CS) domain or the packet switched (PS) domain. The CS domain refers to connections in which dedicated network resources are allocated at the time of connection establishment and then released when the connection is terminated. The PS domain refers to communications and data transfers that make use of autonomous groupings of bits called packets. Each packet may be routed, manipulated, processed or handled independently of all other packets in the PS domain and does not require dedicated network resources.

The circuit-switched MGW function (CS-MGW) 1126 is part of core network 1110, and interacts with VLR/MSC server 1128 and GMSC server 1130 in order to facilitate core network 1110 resource control in the CS domain. Functions of CS-MGW 1126 include, but are not limited to, media conversion, bearer control, payload processing or other mobile network processing such as handover or anchoring. CS-MGW 1126 may receive connections to MS 1102 through BSS 1104 or RNS 1112.

SGSN 1132 stores subscriber data regarding MS 1102 in order to facilitate network functionality. SGSN 1132 may store subscription information such as, but not limited to, the IMSI, temporary identities, or PDP addresses. SGSN 1132 may also store location information such as, but not limited to, GGSN address for each GGSN 1134 where an active PDP exists. GGSN 1134 may implement a location register function to store subscriber data it receives from SGSN 1132 such as subscription or location information.

Serving gateway (S-GW) 1136 is an interface which provides connectivity between E-UTRAN 1118 and core network 1110. Functions of S-GW 1136 include, but are not limited to, packet routing, packet forwarding, transport level packet processing, or user plane mobility anchoring for inter-network mobility. PCRF 1138 uses information gathered from P-GW 1136, as well as other sources, to make applicable policy and charging decisions related to data flows, network resources or other network administration functions. PDN gateway (PDN-GW) 1140 may provide user-to-services connectivity functionality including, but not limited to, GPRS/EPC network anchoring, bearer session anchoring and control, or IP address allocation for PS domain connections.

HSS 1142 is a database for user information and stores subscription data regarding MS 1102 or UE 1124 for handling calls or data sessions. Networks may contain one HSS 1142 or more if additional resources are required. Example data stored by HSS 1142 include, but is not limited to, user identification, numbering or addressing information, security information, or location information. HSS 1142 may also provide call or session establishment procedures in both the PS and CS domains.

VLR/MSC Server 1128 provides user location functionality. When MS 1102 enters a new network location, it begins a registration procedure. A MSC server for that location transfers the location information to the VLR for the area. A VLR and MSC server may be located in the same computing environment, as is shown by VLR/MSC server 1128, or alternatively may be located in separate computing environments. A VLR may contain, but is not limited to, user information such as the IMSI, the Temporary Mobile Station Identity (TMSI), the Local Mobile Station Identity (LMSI), the last known location of the mobile station, or the SGSN where the mobile station was previously registered. The MSC server may contain information such as, but not limited to, procedures for MS 1102 registration or procedures for handover of MS 1102 to a different section of core network 1110. GMSC server 1130 may serve as a connection to alternate GMSC servers for other MSs in larger networks.

EIR 1144 is a logical element which may store the IMEI for MS 1102. User equipment may be classified as either "white listed" or "black listed" depending on its status in the network. If MS 1102 is stolen and put to use by an unauthorized user, it may be registered as "black listed" in EIR 1144, preventing its use on the network. A MME 1146 is a control node which may track MS 1102 or UE 1124 if the devices are idle. Additional functionality may include the ability of MME 1146 to contact idle MS 1102 or UE 1124 if retransmission of a previous session is required.

As described herein, a telecommunications system wherein management and control utilizing a software designed network (SDN) and a simple IP are based, at least in part, on user equipment, may provide a wireless management and control framework that enables common wireless management and control, such as mobility management, radio resource management, QoS, load balancing, etc., across many wireless technologies, e.g. LTE, Wi-Fi, and future 5G access technologies; decoupling the mobility control from data planes to let them evolve and scale independently; reducing network state maintained in the network based on user equipment types to reduce network cost and allow massive scale; shortening cycle time and improving network upgradability; flexibility in creating end-to-end services based on types of user equipment and applications, thus improve customer experience; or improving user equipment power efficiency and battery life—especially for simple M2M devices—through enhanced wireless management.

Figure 12:
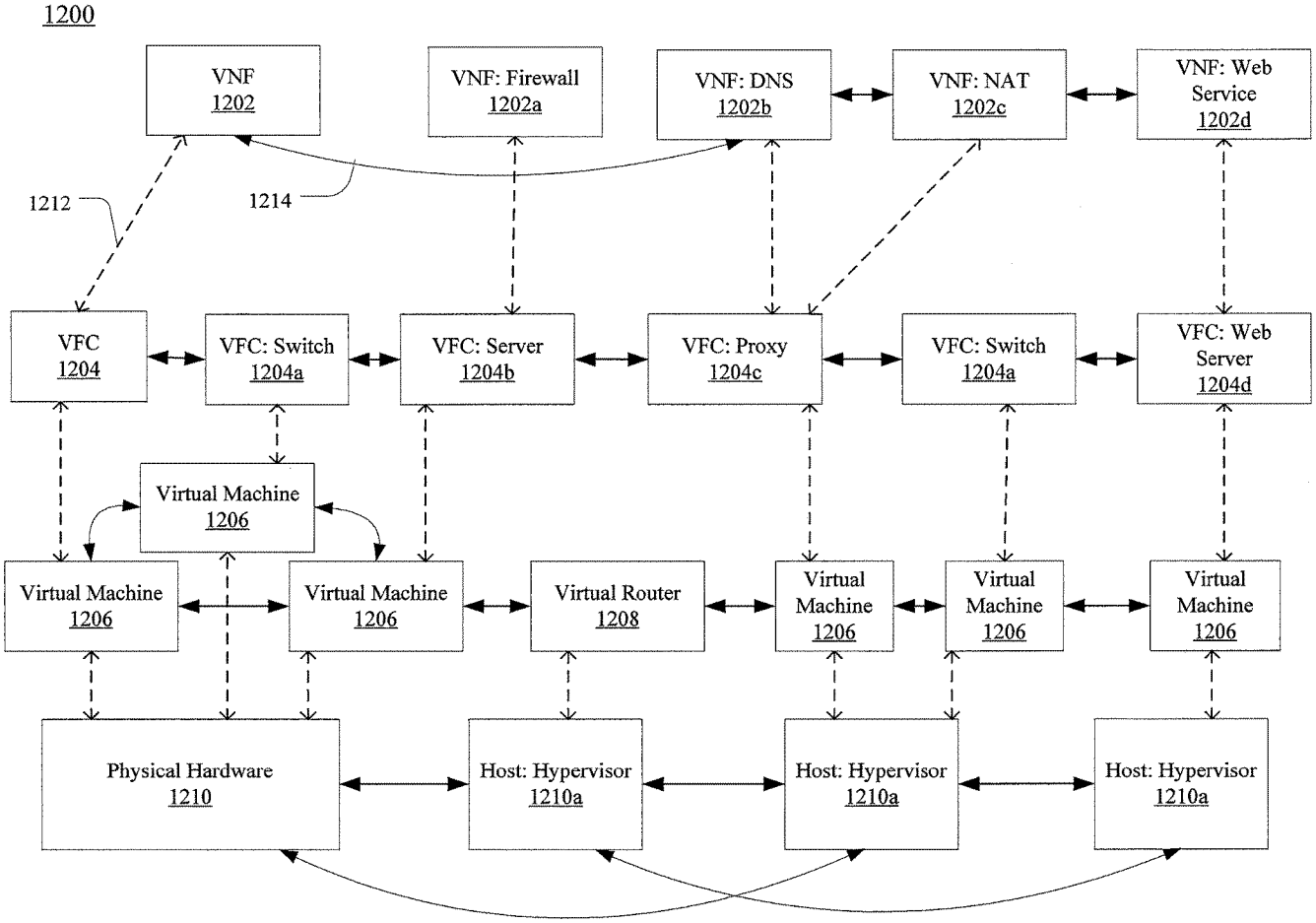
FIG. 12 illustrates a representation of an example network including virtual network functions.

FIG. 12 is a representation of an exemplary network 1200. Network 1200 may comprise an SDN—that is, network 1200 may include one or more virtualized functions implemented on general purpose hardware, such as in lieu of having dedicated hardware for every network function. That is, general purpose hardware of network 1200 may be configured to run virtual network elements to support communication services, such as mobility services, including consumer services and enterprise services. These services may be provided or measured in sessions.

A virtual network functions (VNFs) 1202 may be able to support a limited number of sessions. Each VNF 1202 may have a VNF type that indicates its functionality or role. For example, FIG. 12 illustrates a gateway VNF 1202*a* and a policy and charging rules function (PCRF) VNF 1202*b*. Additionally or alternatively, VNFs 1202 may include other types of VNFs. Each VNF 1202 may use one or more virtual machines (VMs) 1204 to operate. Each VM 1204 may have a VM type that indicates its functionality or role. For example, FIG. 12 illustrates a MCM VM 1204*a*, an ASM VM 1204*b*, and a DEP VM 1204*c*. Additionally or alternatively, VMs 1204 may include other types of VMs. Each VM 1204 may consume various network resources from a hardware platform 1206, such as a resource 1208, a virtual central processing unit (vCPU) 1208*a*, memory 1208*b*, or a network interface card (NIC) 1208*c*. Additionally or alternatively, hardware platform 1206 may include other types of resources 1208.

While FIG. 12 illustrates resources 1208 as collectively contained in hardware platform 1206, the configuration of hardware platform 1206 may isolate, for example, certain memory 1208*c* from other memory 1208*c*.

Hardware platform 1206 may comprise one or more chasses 1210. Chassis 1210 may refer to the physical housing or platform for multiple servers or other network equipment. In an aspect, chassis 1210 may also refer to the underlying network equipment. Chassis 1210 may include one or more servers 1212. Server 1212 may comprise general purpose computer hardware or a computer. In an aspect, chassis 1210 may comprise a metal rack, and servers 1212 of chassis 1210 may comprise blade servers that are physically mounted in or on chassis 1210.

Each server 1212 may include one or more network resources 1208, as illustrated. Servers 1212 may be communicatively coupled together (not shown) in any combination or arrangement. For example, all servers 1212 within a given chassis 1210 may be communicatively coupled. As another example, servers 1212 in different chasses 1210 may be communicatively coupled. Additionally or alternatively, chasses 1210 may be communicatively coupled together (not shown) in any combination or arrangement.

The characteristics of each chassis 1210 and each server 1212 may differ. Additionally or alternatively, the type or number of resources 1210 within each server 1212 may vary. In an aspect, chassis 1210 may be used to group servers 1212 with the same resource characteristics. In another aspect, servers 1212 within the same chassis 1210 may have different resource characteristics.

Given hardware platform 1206, the number of sessions that may be instantiated may vary depending upon how efficiently resources 1208 are assigned to different VMs 1204. For example, assignment of VMs 1204 to particular resources 1208 may be constrained by one or more rules. For example, a first rule may require that resources 1208 assigned to a particular VM 1204 be on the same server 1212 or set of servers 1212. For example, if VM 1204 uses eight vCPUs 1208*a*, 1 GB of memory 1208*b*, and 2 NICs 1208*c*, the rules may require that all of these resources 1208 be sourced from the same server 1212. Additionally or alternatively, VM 1204 may require splitting resources 1208 among multiple servers 1212, but such splitting may need to conform with certain restrictions. For example, resources 1208 for VM 1204 may be able to be split between two servers 1212. Default rules may apply. For example, a default rule may require that all resources 1208 for a given VM 1204 must come from the same server 1212.

An affinity rule may restrict assignment of resources 1208 for a particular VM 1204 (or a particular type of VM 1204). For example, an affinity rule may require that certain VMs 1204 be instantiated on (that is, consume resources from) the same server 1212 or chassis 1210. For example, if VNF 1202 uses six MCM VMs 1204*a*, an affinity rule may dictate that those six MCM VMs 1204*a* be instantiated on the same server 1212 (or chassis 1210). As another example, if VNF 1202 uses MCM VMs 1204*a*, ASM VMs 1204*b*, and a third type of VMs 1204, an affinity rule may dictate that at least the MCM VMs 1204*a* and the ASM VMs 1204*b* be instantiated on the same server 1212 (or chassis 1210). Affinity rules may restrict assignment of resources 1208 based on the identity or type of resource 1208, VNF 1202, VM 1204, chassis 1210, server 1212, or any combination thereof.

An anti-affinity rule may restrict assignment of resources 1208 for a particular VM 1204 (or a particular type of VM 1204). In contrast to an affinity rule—which may require that certain VMs 1204 be instantiated on the same server 1212 or chassis 1210—an anti-affinity rule requires that certain VMs 1204 be instantiated on different servers 1212 (or different chasses 1210). For example, an anti-affinity rule may require that MCM VM 1204*a* be instantiated on a particular server 1212 that does not contain any ASM VMs 1204*b*. As another example, an anti-affinity rule may require that MCM VMs 1204*a* for a first VNF 1202 be instantiated on a different server 1212 (or chassis 1210) than MCM VMs 1204*a* for a second VNF 1202. Anti-affinity rules may restrict assignment of resources 1208 based on the identity or type of resource 1208, VNF 1202, VM 1204, chassis 1210, server 1212, or any combination thereof.

Within these constraints, resources 1208 of hardware platform 1206 may be assigned to be used to instantiate VMs 1204, which in turn may be used to instantiate VNFs 1202, which in turn may be used to establish sessions. The different combinations for how such resources 1208 may be assigned may vary in complexity and efficiency. For example, different assignments may have different limits of the number of sessions that can be established given a particular hardware platform 1206.

For example, consider a session that may require gateway VNF 1202*a* and PCRF VNF 1202*b*. Gateway VNF 1202*a* may require five VMs 1204 instantiated on the same server 1212, and PCRF VNF 1202*b* may require two VMs 1204 instantiated on the same server 1212. (Assume, for this example, that no affinity or anti-affinity rules restrict whether VMs 1204 for PCRF VNF 1202*b* may or must be instantiated on the same or different server 1212 than VMs 1204 for gateway VNF 1202*a*.) In this example, each of two servers 1212 may have sufficient resources 1208 to support 10 VMs 1204. To implement sessions using these two servers 1212, first server 1212 may be instantiated with 10 VMs 1204 to support two instantiations of gateway VNF 1202*a*, and second server 1212 may be instantiated with 9 VMs: five VMs 1204 to support one instantiation of gateway VNF 1202*a* and four VMs 1204 to support two instantiations of PCRF VNF 1202*b*. This may leave the remaining resources 1208 that could have supported the tenth VM 1204 on second server 1212 unused (and unusable for an instantiation of either a gateway VNF 1202*a* or a PCRF VNF 1202*b*). Alternatively, first server 1212 may be instantiated with 10 VMs 1204 for two instantiations of gateway VNF 1202*a* and second server 1212 may be instantiated with 10 VMs 1204 for five instantiations of PCRF VNF 1202*b*, using all available resources 1208 to maximize the number of VMs 1204 instantiated.

Consider, further, how many sessions each gateway VNF 1202*a* and each PCRF VNF 1202*b* may support. This may factor into which assignment of resources 1208 is more efficient. For example, consider if each gateway VNF 1202*a* supports two million sessions, and if each PCRF VNF 1202*b* supports three million sessions. For the first configuration—three total gateway VNFs 1202*a* (which satisfy the gateway requirement for six million sessions) and two total PCRF VNFs 1202*b* (which satisfy the PCRF requirement for six million sessions)—would support a total of six million sessions. For the second configuration two total gateway VNFs 1202*a* (which satisfy the gateway requirement for four million sessions) and five total PCRF VNFs 1202*b* (which satisfy the PCRF requirement for 15 million sessions)—would support a total of four million sessions. Thus, while the first configuration may seem less efficient looking only at the number of available resources 1208 used (as resources 1208 for the tenth possible VM 1204 are unused), the second configuration is actually more efficient from the perspective of being the configuration that can support more the greater number of sessions.

To solve the problem of determining a capacity (or, number of sessions) that can be supported by a given hardware platform 1205, a given requirement for VNFs 1202 to support a session, a capacity for the number of sessions each VNF 1202 (e.g., of a certain type) can support, a given requirement for VMs 1204 for each VNF 1202 (e.g., of a certain type), a give requirement for resources 1208 to support each VM 1204 (e.g., of a certain type), rules dictating the assignment of resources 1208 to one or more VMs 1204 (e.g., affinity and anti-affinity rules), the chasses 1210 and servers 1212 of hardware platform 1206, and the individual resources 1208 of each chassis 1210 or server 1212 (e.g., of a certain type), an integer programming problem may be formulated.

First, a plurality of index sets may be established. For example, index set L may include the set of chasses 1210. For example, if a system allows up to 6 chasses 1210, this set may be:

$$L=\{1, 2, 3, 4, 5, 6\},$$

where 1 is an element of L.

Another index set J may include the set of servers 1212. For example, if a system allows up to 16 servers 1212 per chassis 1210, this set may be:

$$J=\{1, 2, 3, \ldots, 16\},$$

where j is an element of J.

As another example, index set K having at least one element k may include the set of VNFs 1202 that may be considered. For example, this index set may include all types of VNFs 1202 that may be used to instantiate a service. For example, let $$K=\{GW, PCRF\}$$

where GW represents gateway VNFs 1202*a* and PCRF represents PCRF VNFs 1202*b*.

Another index set I(k) may equal the set of VMs 1204 for a VNF 1202*k*. Thus, let $$I(GW)=\{MCM, ASM, IOM, WSM, CCM, DCM\}$$

represent VMs 1204 for gateway VNF 1202*a*, where MCM represents MCM VM 1204*a*, ASM represents ASM VM 1204*b*, and each of IOM, WSM, CCM, and DCM represents a respective type of VM 1204. Further, let $$I(PCRF)=\{DEP, DIR, POL, SES, MAN\}$$

represent VMs 1204 for PCRF VNF 1202*b*, where DEP represents DEP VM 1204*c* and each of DIR, POL, SES, and MAN represent a respective type of VM 1204.

Another index set V may include the set of possible instances of a given VM 1204. For example, if a system allows up to 20 instances of VMs 1202, this set may be:

$$V=\{1, 2, 3, \ldots, 20\},$$

where v is an element of V.

In addition to the sets, the integer programming problem may include additional data. The characteristics of VNFs 1202, VMs 1204, chasses 1210, or servers 1212 may be factored into the problem. This data may be referred to as parameters. For example, for given VNF 1202 k, the number of sessions that VNF 1202 k can support may be defined as a function S(k). In an aspect, for an element k of set K, this parameter may be represented by $$S(k)>=0;$$

is a measurement of the number of sessions k can support. Returning to the earlier example where gateway VNF 1202*a* may support 2 million sessions, then this parameter may be S(GW)=2,000,000.

VM 1204 modularity may be another parameter in the integer programming problem. VM 1204 modularity may represent the VM 1204 requirement for a type of VNF 1202. For example, fork that is an element of set K and i that is an element of set I, each instance of VNF k may require M(k, i) instances of VMs 1204. For example, recall the example where $$I(GW)=\{MCM, ASM, IOM, WSM, CCM, DCM\}.$$

In an example, M(GW, I(GW)) may be the set that indicates the number of each type of VM 1204 that may be required to instantiate gateway VNF 1202*a*. For example, $$M(GW, I(GW))=\{2, 16, 4, 4, 2, 4\}$$

may indicate that one instantiation of gateway VNF 1202*a* may require two instantiations of MCM VMs 1204*a*, 16 instantiations of ACM VM 1204*b*, four instantiations of IOM VM 1204, four instantiations of WSM VM 1204, two instantiations of CCM VM 1204, and four instantiations of DCM VM 1204.

Another parameter may indicate the capacity of hardware platform 1206. For example, a parameter C may indicate the number of vCPUs 1208*a* required for each VM 1204 type i and for each VNF 1202 type k. For example, this may include the parameter C(k, i).

For example, if MCM VM 1204*a* for gateway VNF 1202*a* requires 20 vCPUs 1208*a*, this may be represented as $$C(GW, MCM)=20.$$

However, given the complexity of the integer programming problem—the numerous variables and restrictions that must be satisfied—implementing an algorithm that may be used to solve the integer programming problem efficiently, without sacrificing optimality, may be difficult.

While examples of systems in which communication can be processed and managed have been described in connection with various computing devices/processors, the underlying concepts may be applied to any computing device, processor, or system capable of facilitating a telecommunications system. The various techniques described herein may be implemented in connection with hardware or software or, where appropriate, with a combination of both. Thus, the methods and devices may take the form of program code (i.e., instructions) embodied in concrete, tangible, storage media having a concrete, tangible, physical structure. Examples of tangible storage media include floppy diskettes, CD-ROMs, DVDs, hard drives, or any other tangible machine-readable storage medium (computer-readable storage medium). Thus, a computer-readable storage medium is not a signal. A computer-readable storage medium is not a transient signal. Further, a computer-readable storage medium is not a propagating signal. A computer-readable storage medium as described herein is an article of manufacture. When the program code is loaded into and executed by a machine, such as a computer, the machine becomes an device for telecommunications. In the case of program code execution on programmable computers, the computing device will generally include a processor, a storage medium readable by the processor (including volatile or nonvolatile memory or storage elements), at least one input device, and at least one output device. The program(s) can be implemented in assembly or machine language, if desired. The language can be a compiled or interpreted language, and may be combined with hardware implementations.

The methods and devices associated with systems described herein also may be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like, the machine becomes an device for implementing telecommunications as described herein. When implemented on a general-purpose processor, the program code combines with the processor to provide a unique device that operates to invoke the functionality of a telecommunications system.

While examples of alert systems and techniques, and other aspects relevant to the inventions herein, have been described in connection with various computing devices/processors, the underlying concepts may be applied to other environments, networks, computing devices, processors, or systems subject to similar requirements and constraints. The various techniques described herein may be implemented in connection with hardware or software or, where appropriate, with a combination of both. Thus, the methods and devices may take the form of program code (i.e., instructions) embodied in concrete, tangible, storage media having a concrete, tangible, physical structure. Examples of tangible storage media include floppy diskettes, CD-ROMs, DVDs, hard drives, or any other tangible machine-readable storage medium (computer-readable storage medium). Thus, a computer-readable storage medium is not a signal. A computer-readable storage medium is not a transient signal. Further, a computer-readable storage medium is not a propagating signal. A computer-readable storage medium as described herein is an article of manufacture. When the program code is loaded into and executed by a machine, such as a computer, the machine becomes a device for telecommunications. In the case of program code execution on programmable computers, the computing device will generally include a processor, a storage medium readable by the processor (including volatile or nonvolatile memory or storage elements), at least one input device, and at least one output device. The program(s) can be implemented in assembly or machine language, if desired. The language can be a compiled or interpreted language, and may be combined with hardware implementations.

The systems, methods, and/or techniques associated with alert systems and associated methods described herein also may be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like, the machine becomes an device for implementing telecommunications as described herein. When implemented on a general-purpose processor, the program code combines with the processor to provide a unique device that operates to invoke the functionality of a telecommunications system.

While techniques herein are described in connection with the various examples of the various figures, it is to be understood that other similar implementations may be used, or modifications and additions may be made to the described example techniques, without deviating from the scope or spirit of the innovation. For example, one skilled in the art will recognize that emergent event alert techniques herein may apply to environments other than those expressly identified, whether wired or wireless, and may be applied to any number of such environments via a communications network and interacting across the network. Therefore, emergent event alerts as described herein should not be limited to any single example, but rather should be construed in breadth and scope in accordance with the appended claims and the entirety of the disclosure.

In describing preferred methods, systems, or apparatuses of the subject matter of the present disclosure—emergent event alert systems or methods utilizing such—as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art (e.g., skipping steps, combining steps, or adding steps between exemplary methods disclosed herein). Such other examples are intended to be within the scope of the claims if they have structural elements that do not differ from the literal language of the claims, or if they include equivalent structural elements with insubstantial differences from the literal languages of the claims.

What is claimed is:

1. A method, comprising:

receiving, at a server, information about an emergent event;

identifying one or more parties interested in the emergent event based on the information;

identifying a plurality of devices associated with the one or more parties;

identifying a plurality of channels to connect to the plurality of devices, wherein the channels include two or more of a voice channel, a short message service channel, and an application channel;

generating a plurality of notification priorities, wherein each of the plurality of notification priorities is associated with a channel for one of the plurality of devices, and wherein each of the plurality of notification priorities is based on how recently the one or more parties used each of the plurality of devices and notification success history associated with each of the plurality of devices;

generating one or more emergent event alerts in response to notification of the emergent event, wherein the one or more emergent event alerts are configured to be compatible with one or more of the plurality of devices;

determining a notification success probability for each of the plurality of devices based on device parameters and notification success history associated with each of the plurality of devices;

determining a receiving device among the plurality of devices based on the notification success probability and notification priorities for each of the plurality of devices, wherein the receiving device requires an involuntary override operation to output the emergent event alert;

transmitting, from the server, at least one of the emergent event alerts over at least one of the plurality of channels;

initiating, at the server, the involuntary override operation on the receiving device; and presenting at least one of the one or more emergent event alerts on one or more of the plurality of devices including the receiving device.

2. The method of claim 1, further comprising:

receiving, at the server, a failure notification regarding at least one of the plurality of the emergent event alerts on at least one device, wherein determining to initiate the involuntary override operation occurs after receiving the failure notification.

3. The method of claim 1, wherein the involuntary override operation causes one of the plurality of devices to power cycle to restart in a non-captive mode.

4. The method of claim 1, wherein the information about the emergent event is received from at least one of the one or more parties.

5. The method of claim 1, wherein the information about the emergent event is inferred based on sensor data.

6. The method of claim 1, wherein the device parameters include power to a device, battery life of a device, interfaces available to the device, presence of an application on a device, and whether the device is in use or how recently the device was last used.

7. The method of claim 1, wherein the notification success history includes previous acknowledgment of notifications using the device.

8. A system, comprising:

a server configured to:

receive details regarding an emergent event;

determine a private personal relevance of the emergent event to at least one party;

identify a plurality of devices associated with the at least one party based on the private personal relevance;

identify a plurality of channels to connect to the plurality of devices, wherein the channels include two or more of a voice channel, a short message service channel, and an application channel;

generate a plurality of notification priorities, wherein each of the plurality of notification priorities is associated with a channel for one of the plurality of devices, and wherein each of the plurality of notification priorities is based on how recently the one or more parties used each of the plurality of devices and notification success history associated with each of the plurality of devices;

generate an emergent event alert in response to notification of the emergent event, wherein the emergent event alert is configured to be compatible with one or more of the plurality of devices;

determine a notification success probability for each of the plurality of devices based on device parameters and notification success history associated with each of the plurality of devices;

determine a receiving device among the plurality of devices based on the notification success probability and notification priorities for each of the plurality of devices, wherein the receiving device requires an involuntary override operation to output the emergent event alert;

transmit the emergent event alert to at least one of the plurality of devices over at least one of the plurality of channels; and initiate the involuntary override operation on the receiving device, and the emergent event alert is presented on one or more of the plurality of devices including the receiving device.

9. The system of claim 8, wherein the server is further configured to:

generate at least one subsequent emergent event alert, wherein the subsequent emergent event alert is a different alert or directed to one or more other of the plurality of devices, and wherein the subsequent emergent event alert is transmitted to the at least one of the plurality of devices or the one or more other of the plurality of devices following a timeout period during which the emergent event alert is not acknowledged.

10. The system of claim 8, wherein the one or more other of the plurality of devices are a subsequent device tier, and wherein one or more device tiers including the subsequent device tier correspond to a threshold probability of success associated with devices of a respective tier.

11. The system of claim 8, wherein the emergent event concerns a person, and wherein the private personal relevance is a familial relationship with the person.

* * * * *